US007176429B2

(12) United States Patent
Suyama et al.

(10) Patent No.: US 7,176,429 B2
(45) Date of Patent: Feb. 13, 2007

(54) ELECTRON TUBE

(75) Inventors: Motohiro Suyama, Hamamatsu (JP); Hiroyuki Kyushima, Hamamatsu (JP); Yasuharu Negi, Hamamatsu (JP); Atsuhito Fukasawa, Hamamatsu (JP); Yoshihiko Kawai, Hamamatsu (JP); Yasuyuki Egawa, Hamamatsu (JP); Atsushi Uchiyama, Hamamatsu (JP); Suenori Kimura, Hamamatsu (JP)

(73) Assignee: Hamamatsu Photonics K.K., Hamamatsu (JP)

( * ) Notice: Subject to any disclaimer, the term of this patent is extended or adjusted under 35 U.S.C. 154(b) by 0 days.

(21) Appl. No.: 10/571,292

(22) PCT Filed: Sep. 9, 2004

(86) PCT No.: PCT/JP2004/013130

§ 371 (c)(1),
(2), (4) Date: Mar. 9, 2006

(87) PCT Pub. No.: WO2005/027178

PCT Pub. Date: Mar. 24, 2005

(65) Prior Publication Data

US 2007/0001093 A1 Jan. 4, 2007

(30) Foreign Application Priority Data

Sep. 10, 2003 (JP) ..... 2003-318244

(51) Int. Cl.
*H01J 40/16* (2006.01)

(52) U.S. Cl. ..... 250/207; 250/214 VT; 313/524; 313/541

(58) Field of Classification Search ..... 250/207, 250/214 VT; 313/524, 541
See application file for complete search history.

(56) References Cited

U.S. PATENT DOCUMENTS 5,780,913 A * 7/1998 Muramatsu et al. ..... 257/429
5,874,728 A 2/1999 Suyama et al.

FOREIGN PATENT DOCUMENTS

| | | |
|---|---|---|
| JP | U-46-19162 | 7/1971 |
| JP | A-08-148113 | 6/1996 |
| JP | A-09-297055 | 11/1997 |
| JP | A-09-312145 | 12/1997 |

* cited by examiner

*Primary Examiner*—John R. Lee
(74) *Attorney, Agent, or Firm*—Oliff & Berridge, PLC

(57) ABSTRACT

In an electron tube, one end of an insulating tube is protruded toward the inside of an envelope, and an avalanche photodiode (APD) is provided on the one end of the insulating tube. Another end of the insulating tube is connected to an outer stem of the envelope. Alkali sources are provided inside the envelope. The alkali sources are disposed inside the envelope and generates alkali metal vapor to thereby form a photocathode on a predetermined part of the internal surface of the envelope. The alkali sources and insulating tube are isolated from each other by a separating member. When the electron tube is manufactured, the alkali metal vapor that is generated from the alkali sources is not deposited on the insulating tube due to existence of the separating member. This prevents voltage resistance between the envelope and APD from being decreased and the electrical field in the electron tube from being adversely affected, thereby preventing incident efficiency of electrons to the APD from being decreased.

9 Claims, 16 Drawing Sheets

ELECTRON TUBE

TECHNICAL FIELD

The present invention relates to an electron tube.

BACKGROUND ART

In recent years, an electron tube having a photocathode and an electron-bombarded semiconductor device has been proposed. The photocathode emits a photoelectron in response to an incident light. The electron-bombarded semiconductor device multiplies and detects a photoelectron. As the electron-bombarded semiconductor device, an avalanche photodiode (hereinafter, referred to as APD) has been mainly used.

In an electron tube using the APD, an entrance window and a conductive stem are disposed opposite to each other at both ends of an insulating container. The photocathode is formed on the internal surface of the entrance window, and the APD is disposed on the conductive stem. A ground voltage is applied to the conductive stem, and a negative high voltage is applied to the photocathode. The conductive stem is electrically insulated from the photocathode by the insulating container. Therefore, the vicinity of the photocathode of the insulating container becomes a negative high voltage (refer to, for example, Patent Document 1 or 2).

Further, as the electron tube using the APD, an electron tube in which a conductive stem protrudes inside the insulating container has been proposed (refer to, for example, Patent Document 3).

[Patent Document 1]

Japanese Patent Application Laid-Open Publication No. 8-148113 (pages 3 to 8, FIG. 1)

[Patent Document 2]

Japanese Patent Application Laid-Open Publication No. 9-312145 (pages 3 to 6, FIG. 1)

[Patent Document 3]

Japanese Patent Application Laid-Open Publication No. 9-297055 (pages 4 to 9, FIG. 4)

DISCLOSURE OF INVENTION

Objects of the Invention

However, the above-described conventional electron tube is hard to handle since a negative high voltage is exposed in the vicinity of the photocathode of the insulating container. Further, a large potential difference is generated between the photocathode or anode side and external environment. Then there is a risk of generating a discharge between the electron tube and external environment.

An object of the present invention is, therefore, to provide an electron tube that is easy to handle at the time of use and has a high degree of safety.

Arrangement Solving the Problem

To attain the above object, the present invention provides an electron tube including: an envelope formed with a photocathode at a predetermined part of an internal surface thereof; an insulating tube having one end and another end, the another end being connected to the envelope and the one end protruding inside the envelope; an electron-bombarded semiconductor device provided on the one end of the tube; an alkali source provided inside the envelope to generate alkali metal vapor; and a separating member disposed between the alkali source and the tube, wherein the semiconductor device detects photoelectrons emitted from the photocathode in response to an incident light thereon.

According to the above configuration, the electron tube of the present invention includes the envelope, insulating tube, semiconductor device, alkali source, and separating member. The one end of the insulating tube protrudes inside the envelope, and semiconductor device is provided on the one end of the tube. The another end of the insulating tube is connected to the envelope. The alkali source is provided inside the envelope. The alkali source generates alkali metal vapor to thereby form the photocathode on a predetermined part of the envelope. The alkali source is isolated from the tube by the separating member.

In the electron tube having the above configuration, the semiconductor device protrudes inside the envelope. Therefore, when a ground voltage and a voltage having a positive polarity are applied to the envelope and semiconductor device, respectively, a voltage having a high absolute value can be prevented from being exposed to the outside environment. Therefore, the electron tube can easily be handled and occurrence of discharge between the envelope and outside environment can be prevented.

Further, the alkali source is isolated from the tube by the separating member. This prevents alkali metal vapor from being deposited on the tube, when the alkali source generates the alkali metal vapor to thereby form the photocathode on the predetermined part of the envelope. As a result, the alkali metal is not adhered to the tube, preventing a decrease in work function of the surface of the tube, which results in prevention of a reduction in voltage resistance or adverse influence on the field intensity in the vicinity of the tube. Therefore, the electrons can efficiently be detected.

Preferably, the separating member may include the partition wall located between the alkali source and tube. The electron tube further including: an inner stem connected to the one end of the tube via a conductive member; and a conductive member provided on the one end of the tube and protruding outside the tube to reduce the field intensity in the vicinity of the one end of the tube, wherein the semiconductor device is disposed on the inner stem.

According to the above configuration, the separating member is a partition wall, the inner stem is connected to the one end of the insulating tube via the conductive member, and the semiconductor device is disposed on the inner stem. The conductive member protrudes from the one end of the insulating tube. The conductive member reduces the field intensity in the vicinity of the one end of the tube.

According to the electron tube having the above configuration, the field intensity in the vicinity of the one end of the insulating tube is reduced by the conductive member, thereby preventing occurrence of discharge. Therefore, a large potential difference can be applied between the photocathode and semiconductor device to thereby increase detection efficiency.

Preferably, the electron tube of the present invention may include further a conductive member provided on the another end of the tube and protruding outside the tube to reduce the field intensity in the vicinity of the another end of the tube, wherein the envelope further comprises an outer stem connected to the another end of the tube, at least a part of the outer stem that is connected to the another end of the tube being conductive.

According to the above configuration, the envelope has the outer stem. The outer stem is connected to the another end of the tube. At least a part of the outer stem that is connected to the another end of the tube is a conductive property. Further, the conductive member protrudes from the another end of the insulating tube. The conductive member reduces the field intensity in the vicinity of the one end of the tube.

According to the electron tube having the above configuration, the field intensity in the another end of the insulating tube is reduced by the conductive member, thereby preventing occurrence of discharge. Therefore, a large potential difference can be applied between the photocathode and semiconductor device to thereby increase detection efficiency.

Preferably, the envelope may be applied with a ground potential, and the semiconductor device is applied with a positive potential.

According to the above configuration, a ground potential is applied to the envelope and a positive polarity is applied to the semiconductor device. The envelope is electrically insulated from semiconductor device by the insulating tube.

In the electron tube having the above configuration, a voltage having a positive polarity is applied to the semiconductor device that protrudes inside the envelope and a ground voltage is applied to the envelope that is exposed to the outside, preventing a high absolute value of the electric potential from being exposed to the outside environment. As a result, the electron tube can easily be handled and occurrence of discharge between the envelope and outside environment can be prevented. Therefore, the electron tube can be used for single photon detection in water, such as the water Cerenkov experiment or the like.

Preferably, the separating member may be either a conductive member provided on the one end of the tube and protruding outside the tube to reduce the field intensity in the vicinity of the one end of the tube or a conductive member provided on the another end of the tube and protruding outside the tube to reduce the field intensity in the vicinity of the another end of the tube.

According to the above configuration, the conductive member protruding from an end portion of the tube prevents the alkali metal vapor generated from the alkali source from being adhered to the tube as well as reduces field intensity in the vicinity of the end portions of the tube.

According to the electron tube having the above configuration, the alkali source is isolated from the tube by the conductive member. This prevents alkali metal vapor from being deposited on the tube when the alkali source generates the alkali metal vapor to thereby form the photocathode on a predetermined part of the envelope. As a result, the alkali metal is not adhered to the tube, preventing a decrease in work function of the surface of the tube, which results in prevention of a reduction in voltage resistance or adverse influence on the field intensity in the vicinity of the tube. Therefore, the electron can efficiently be detected.

Further, the field intensity in the vicinity of the end portion of the insulating tube is reduced by the conductive member, thereby preventing occurrence of discharge. Therefore, a large potential difference can be applied between the photocathode and semiconductor device to thereby increase detection efficiency.

Preferably, the separating member may include a conductive member provided on the one end of the tube and protruding outside the tube to reduce the field intensity in the vicinity of the one end of the tube and a conductive member provided on the another end of the tube and protruding outside the tube to reduce the field intensity in the vicinity of the another end of the tube.

According to the above configuration, the conductive members protruding from the end portions of the tube prevent the alkali metal vapor generated from the alkali source from being adhered to the tube as well as reduce field intensity in the vicinity of the end portions of the tube.

According to the electron tube having the above configuration, the alkali source is isolated from the tube by the conductive members. This prevents alkali metal vapor from being deposited on the tube when the alkali source generates the alkali metal vapor to thereby form the photocathode on a predetermined part of the envelope. As a result, the alkali metal is not adhered to the tube, preventing a decrease in work function of the surface of the tube, which results in prevention of a reduction in voltage resistance or adverse influence on the field intensity in the vicinity of the tube. Therefore, the electron can efficiently be detected.

Further, the field intensity in the vicinity of the end portions of the insulating tube is reduced by the conductive members, thereby preventing occurrence of discharge. Therefore, a large potential difference can be applied between the photocathode and semiconductor device to thereby increase detection efficiency.

Preferably, the conductive member and conductive member may be partially overlapped with each other in the axial direction of the tube.

According to the above configuration, the conductive members which are protruding from the both end portions of the tube and which are partially overlapped with each other in the axial direction of the tube prevent the alkali metal vapor generated from the alkali source from being adhered to the tube as well as reduce the field intensity in the vicinity of the both end portions of the tube.

According to the electron tube having the above configuration, the alkali source is isolated from the tube by the conductive members. The conductive members are protruding from the both end portions of the tube and are partially overlapped with each other in the direction perpendicular to a side surface of the tube. This efficiently prevents alkali metal from being deposited on the tube when the alkali source generates the alkali metal vapor to form the photocathode on a given part of the envelope. As a result, the alkali metal vapor is not adhered to the tube, preventing a decrease in work function of the surface of the tube, which results in prevention of a reduction in voltage resistance or adverse influence on the field intensity in the vicinity of the tube. Therefore, the electron can efficiently be detected.

Further, the field intensity in the vicinity of the end portions of the insulating tube is reduced by the conductive members, thereby preventing occurrence of discharge. Therefore, a large potential difference can be applied between the photocathode and semiconductor device to thereby increase detection efficiency.

EXPLANATION OF REFERENCE NUMBERS

Figure 1:
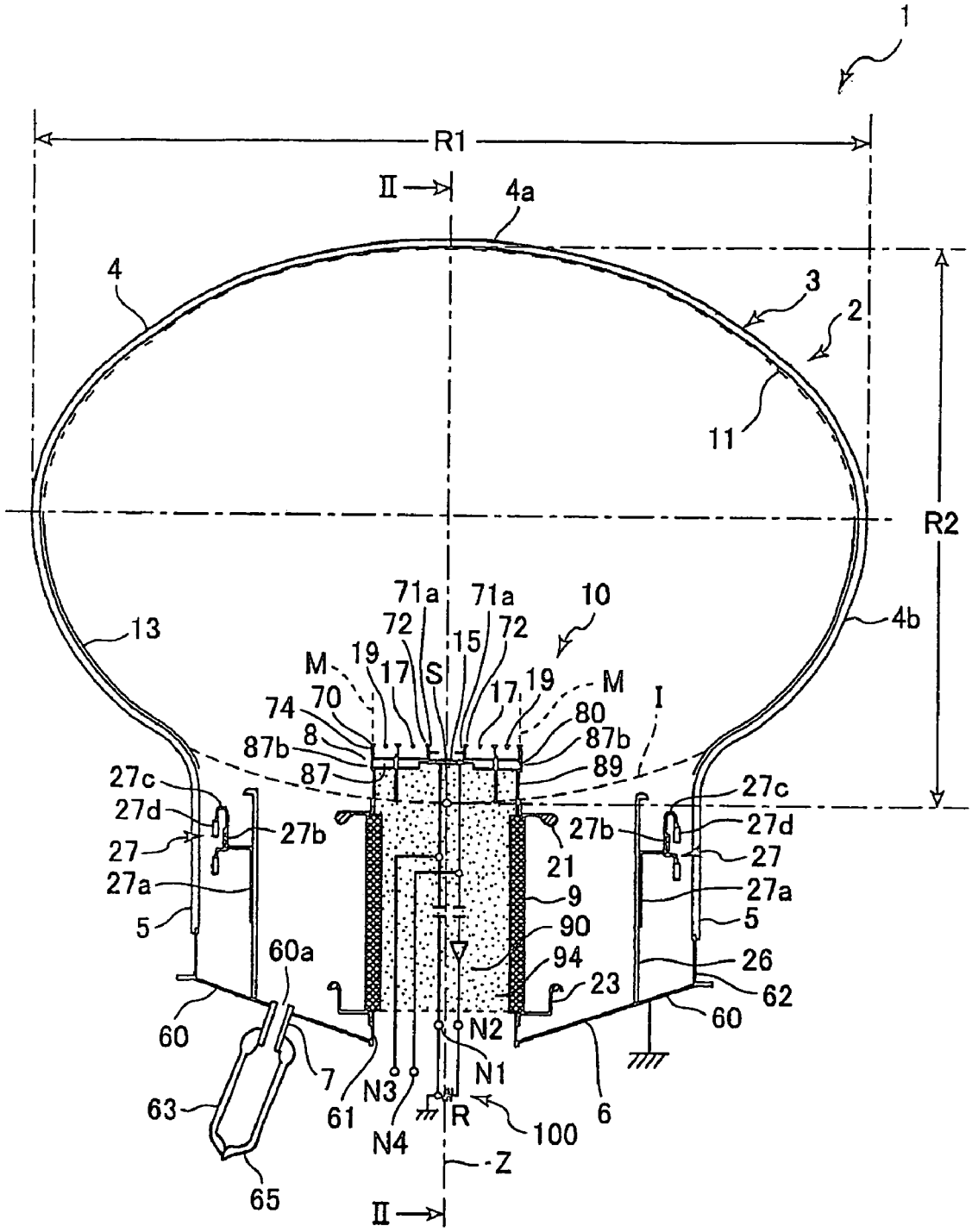
FIG. 1 is a cross-sectional view schematically showing an electron tube according to an embodiment of the present invention.

1: Electron tube
2: Envelope
3: Glass bulb
4: Glass bulb body
4*a*: Upper hemisphere
4*b*: Lower hemisphere
5: Glass bulb base
6: Outer stem
9: Insulating tube
10: Electron detection section
15: APD
21, 23: Conductive flange
21', 23': Conductive flange
26: Partition wall
27: Alkali source
60: Stem bottom
61: Stem inner wall
62: Stem outer wall
70: Shield portion
71: Cover
72: Inner wall
73: Cap
74: Outer wall
80: Inner stem
87: Base
89: Conductive support portion
90: Electrical circuit
I: Imaginary extended curved surface of lower hemisphere 4*b*
M: Imaginary extended curved surface of outer periphery 87*b*
S: Reference point
Z: Axis

BEST MODE FOR CARRYING OUT THE INVENTION

An electron tube according to an embodiment of the present invention will be described below with reference to FIGS. 1 to 19.

FIG. 1 is a vertical cross-sectional view schematically showing an electron tube 1 according to the embodiment of the present invention.

As shown in FIG. 1, the electron tube 1 includes an envelope 2 and an electron detection section 10. The envelope 2 has an axis Z. The electron detection section 10 protrudes inside the envelope 2 along the axis Z. The electron detection section 10 has substantially a cylindrical shape extending with its central axis being located on the axis Z.

The envelope 2 has a glass bulb 3 and an outer stem 6. The glass bulb 3 is formed from a transparent glass.

The glass bulb 3 has a glass bulb body 4 and a cylindrical glass bulb base 5. The glass bulb body 4 is integrally formed with the glass bulb base 5. The glass bulb body 4 has substantially a spherical shape having a central axis located on the axis Z. As shown in FIG. 1, the cross-section of the glass bulb body 4 taken along the axis Z has a first diameter R1 perpendicular to the axis Z and a second diameter R2 parallel to the axis Z. The cross-section of the glass bulb body 4 taken along the axis Z has substantially an elliptical shape with the first diameter R1 longer than the second diameter R2. The cylindrical glass bulb base 5 extends with its central axis being located on the axis Z.

The glass bulb body 4 integrally includes an upper hemisphere 4*a* and a lower hemisphere 4*b*. The upper hemisphere 4*a* serves as the upper hemisphere of the glass bulb 4 in the drawing, and is curved substantially spherically to form a semispherical shape. The lower hemisphere 4*b* serves as the lower hemisphere of the glass bulb 4 in the drawing, and is curved substantially spherically to form a semispherical shape. Hereinafter, in FIG. 1, the upper hemisphere 4*a* is defined as the upper side with respect to the lower hemisphere 4*a*. The lower hemisphere 4*b* is defined as the lower side with respect to the upper hemisphere 4*a*. The lower end of the upper hemisphere 4*a* is connected to the upper end of the lower hemisphere 4*b*. The lower end of the lower hemisphere 4*b* is connected to the upper end of the glass bulb base 5. The glass bulb 3 is thus integrally formed. A imaginary extended curved surface I of the lower hemisphere 4*b* crosses the axis Z at a reference point S that is located inside the glass bulb base 5.

A photocathode 11 is formed on the internal surface of the upper hemisphere 4*a*. The photocathode 11 is a thin film formed by a vapor deposition technique using antimony (Sb), manganese (Mn), potassium (K), and cesium (Cs).

A conductive thin film 13 is formed on the internal surface of the lower hemisphere 4*b*. The upper end of the conductive thin film 13 is brought into contact with the lower end of the photocathode 11. Although the conductive thin film 13 is a chromium thin film in this embodiment, the thin film 13 may be formed from an aluminum thin film.

The outer stem 6 is formed from conductive Kovar metal. The outer stem 6 includes a stem bottom 60, a stem inner wall 61, and a stem outer wall 62. The stem bottom 60 has substantially an annular shape with its central axis located on the axis Z and is inclined downward toward the axis Z. The stem inner wall 61 and stem outer wall 62 have cylindrical shapes with their common central axis coinciding with the axis Z. The stem inner wall 61 extends upward from the inner edge of the stem bottom 60. The stem outer wall 62 extends upward from the outer edge of the stem bottom 60. The upper end of the stem outer wall 62 is air-tightly connected to the lower edge of the glass bulb base 5. The upper end of the stem inner wall 61 is air-tightly connected to the lower end of the electron detection section 10. Thus, the electron detection section 10 having substantially a cylindrical shape protrudes from the outer stem 6 side toward the photocathode 11 side coaxially with the cylindrical glass bulb base 5.

A cylindrical-shaped partition wall 26 is provided between the cylindrical glass bulb base 5 and the substantially cylindrical electron detection section 10 coaxially therewith. The partition wall 26 is formed, for example, from a conductive material such as a stainless steel. The lower end of the partition wall 26 is connected to the stem bottom 60. The upper end of the partition wall 26 is located on the upper hemisphere 4*a* side (i.e., upper side in FIG. 1) relative to the reference point S with respect to the direction parallel to the axis Z. The upper end of the partition wall 26 is located on the glass bulb base 5 side (i.e., lower side) relative to the imaginary extended curved surface I of the lower hemisphere 4*b*.

Two alkali sources 27, 27 are provided on the outer side surface of the partition wall 26, i.e., on the side that faces the glass bulb base 5. The two alkali sources 27, 27 are symmetrically provided with respect to the axis Z. Each of the alkali sources 27, 27 has a support portion 27*a*, a holding plate 27*b*, an attachment portion 27*c*, and six containers 27*d*. In FIG. 1, only two containers 27*d* are shown for each alkali source 27. The containers 27*d* are located on the outer stem 6 side (i.e., lower side) relative to the upper end of the partition wall 26 with respect to the direction parallel to the axis Z.

An opening 60*a* is formed in the stem bottom 60 at the position between the electron detection section 10 and partition wall 26. The opening 60*a* communicates with an exhaust pipe 7. The exhaust pipe 7 is formed, for example, from Kovar metal.

A glass tube 63 is connected to the exhaust pipe 7. The glass tube 63 is formed from, for example, Kovar glass. The glass tube 63 is sealed at an end portion 65 thereof.

The electron detection section 10 has an insulating tube 9. The insulating tube 9 is formed, for example, from ceramics. The insulating tube 9 has a cylindrical shape. The insulating tube has a central axis extending along the axis Z.

The lower end of the insulating tube 9 is air-tightly connected to the upper end of the stem inner wall 61. A conductive flange 23 is provided at the lower end of the insulating tube 9. An electron detection section head portion 8 is disposed at the upper end of the insulating tube 9. The electron detection section head portion 8 faces the photocathode 11. A conductive flange 21 is provided at the upper end of the insulating tube 9. The conductive flanges 21 and 23 protrude in the direction away from the axis Z, i.e., in the direction from the insulating tube 9 toward the glass bulb base 5. Each of the conductive flanges 21 and 23 has a plate-like shape circumferentially extending on the plane perpendicular to the axis Z. The upper end of the insulating tube 9 is located on the outer stem 6 side (i.e., lower side) relative to the upper end of the partition wall 26 with respect to the direction parallel to the axis Z.

The electron detection section head portion 8 has a conductive support portion 89. The conductive support portion 89 has a cylindrical shape with its central axis being located on the axis Z. The lower end of the conductive support portion 89 is air-tightly connected to the upper end of the insulating tube 9.

The electron detection section head portion 8 further has an inner stem 80. The inner stem 80 has substantially a disc shape with its central axis being located on the axis Z. The outer edge of the inner stem 80 is air-tightly connected to the upper end of the conductive support portion 89. An APD (Avalanche Photodiode) 15, two manganese beads 17, and two antimony beads 19 are disposed on the inner stem 80. Thus, the inner stem 80 serves as a base plate that holds the APD 15, manganese beads 17, and antimony beads 19. Further, on the inner stem 80, a shield portion 70 for shielding the APD 15, manganese beads 17, and antimony beads 19 is disposed facing the upper hemisphere 4*a*.

The APD 15 is located on the axis Z and on the upper hemisphere 4*a* side (i.e., upper side) relative to the reference point S. Further, the APD 15 is located on the upper hemisphere 4*a* side (i.e., upper side) relative to the upper end of the partition wall 26, with respect to the direction parallel to the axis Z.

An electrical circuit 90 connected to the electron detection section head portion 8 is encapsulated inside the insulating tube 9 with a filling material 94. The filling material 94 is, for example, an insulating material such as silicon. The electrical circuit 90 has output terminals N1, N2 and input terminals N3, N4. The output terminals N1, N2 and input terminals N3, N4 are exposed outside the filling material 94. The output terminals N1, N2 are connected to an external circuit 100. The input terminals N3, N4 are connected to an external power supply (not shown).

Figure 2:
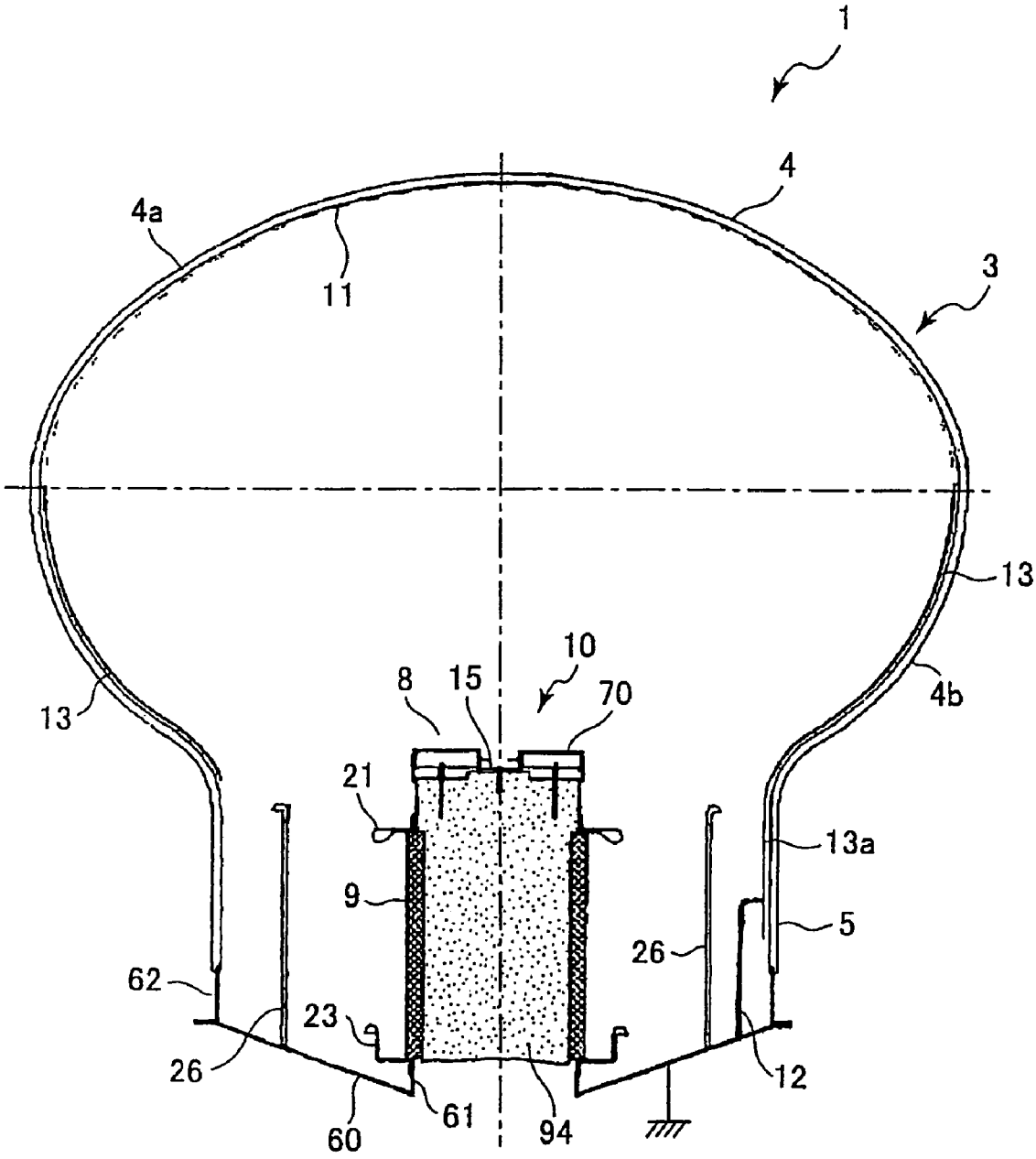
FIG. 2 is a vertical cross-sectional view taken along the line II—II in the electron tube of FIG. 1.

FIG. 2 is a vertical cross-sectional view taken along the II—II line in FIG. 1. In other words, FIG. 2 shows the vertical cross-section of the electron tube 1 seeing from the direction different from the direction of the electron tube of FIG. 1 by 90 degrees about the axis Z. In FIG. 2, showing of the electrical circuit 90 in the insulating tube 9 is omitted in order to make the overall structure clearer.

Viewed from the angle shown in FIG. 2, a part of the conductive thin film 13 extends from the glass bulb body 4 to the glass bulb base 5. This extended part of the conductive thin film 13 is referred to as a thin film extension 13*a*. A connection electrode 12 extends from the stem bottom 60 and connects the stem bottom 60 with the thin film extension 13*a*. Thus, electrical continuity is established between the conductive thin film 13 and outer stem 6. Accordingly, electrical continuity is also established between the photocathode 11 and outer stem 6.

Details of the configuration of the electron detection section 10 will be described with reference to FIGS. 1 to 7.

Figure 3:
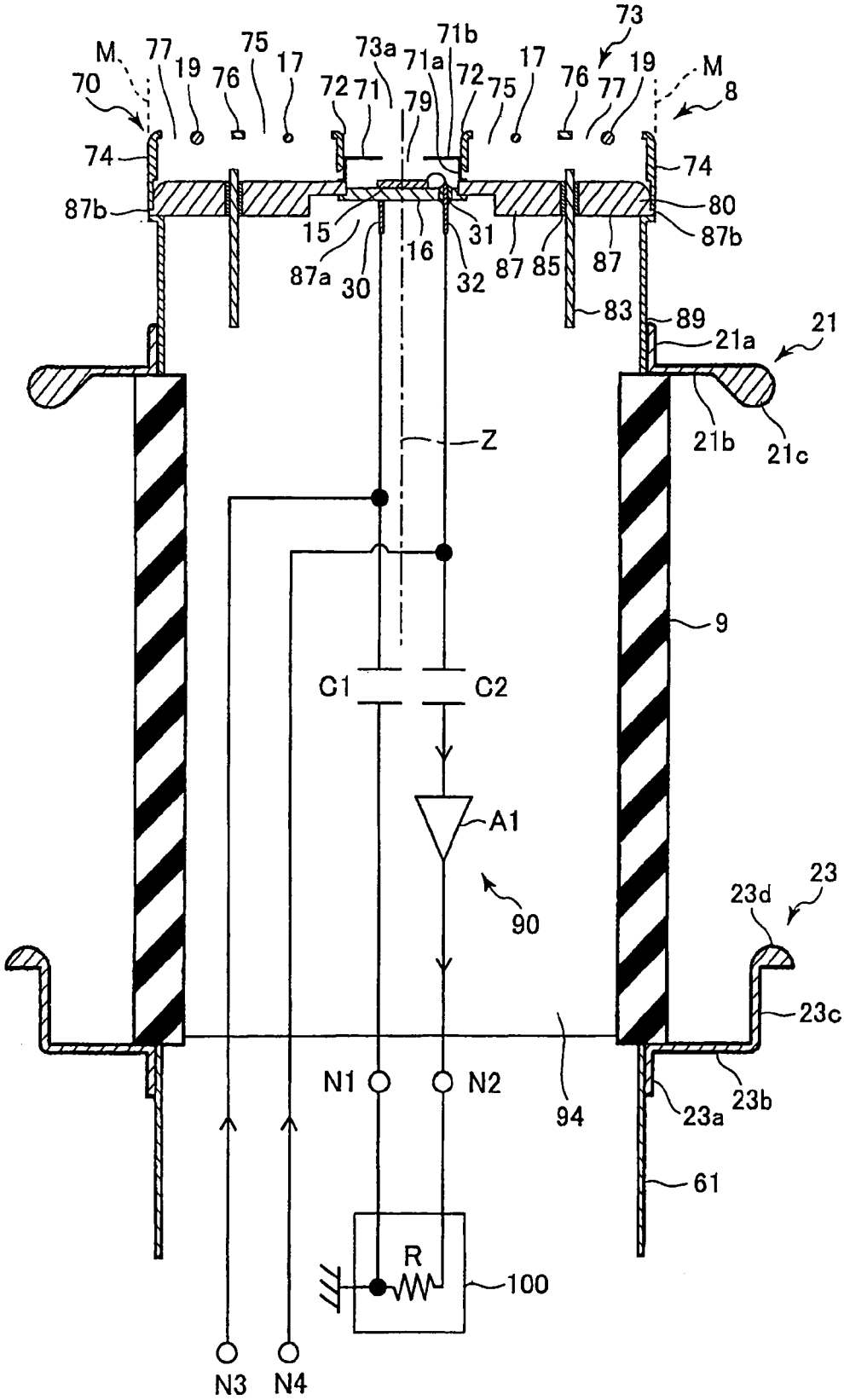
FIG. 3 is a vertical cross-sectional view of an electron detection section provided in the electron tube of FIG. 1 illustrating an electrical circuit provided in the electron detection section in detail.
Figure 4:
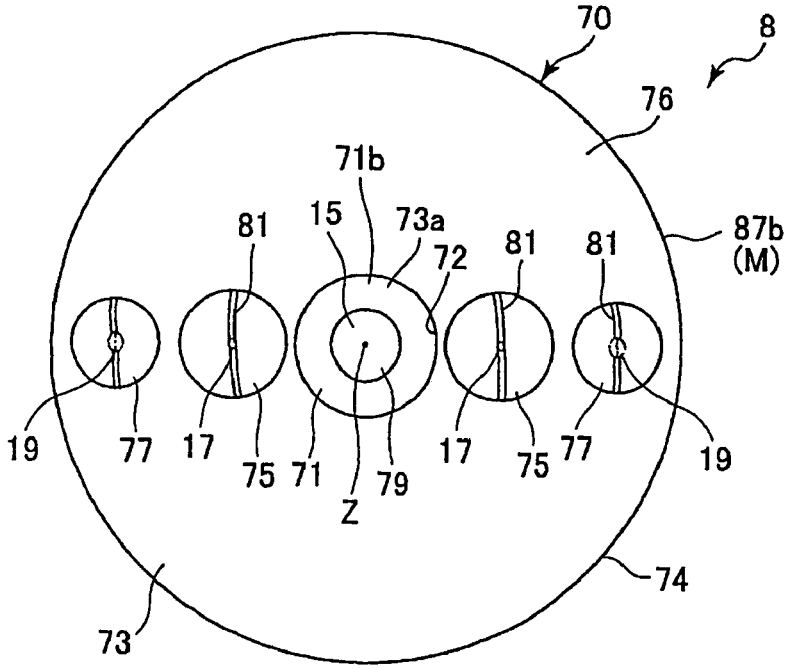
FIG. 4 is a plan view showing an electron detection section head portion as viewed from above.

FIG. 3 shows the vertical cross-section of the electron detection section 10 of FIG. 1 in greater detail. FIG. 4 is a plan view of the electron detection section head portion 8 of the electron detection section 10 as viewed from the photocathode 11 side.

As shown in FIG. 3, the conductive flange 23 is provided at the connection portion between the insulating tube 9 and conductive stem inner wall 61 and is connected to both the insulating tube 9 and stem inner wall 61. The conductive flange 23 is formed from a conductive material.

The conductive flange 23 has a connection portion 23*a*, a flange body 23*b*, rising portion 23*c*, and a rounded leading end 23*d*. The connection portion 23*a* has a cylindrical shape and is fixed to the outer surface of the cylindrical stem inner wall 61. The flange body 23*b* has an annular plate-like shape extending in the direction away from the axis Z. The rising portion 23*c* has a cylindrical shape extending upward from the outer edge of the flange body 23*b* in parallel to the axis Z. The rounded leading end 23*d* extends from the upper end of the rising portion 23*c* in the direction away from the axis Z. The rounded leading end 23*d* has a greater thickness than those of the connection portion 23*a*, flange body 23*b*, and rising portion 23*c*, and has a thick rounded shape.

The conductive flange 21 is provided at the connection portion between the insulating tube 9 and conductive support portion 89 and is connected to both the insulating tube 9 and conductive support portion 89. The conductive flange 21 is formed from a conductive material.

The conductive flange 21 has a connection portion 21*a*, a flange body 21*b*, and a rounded leading end 21*c*. The connection portion 21*a* has a cylindrical shape and is fixed to the outer surface of the cylindrical conductive support portion 89. The flange body 21*b* has an annular plate-like shape extending in the direction away from the axis Z. The rounded leading end 21*c* is formed in the outer circumference of the flange body 21*b*. The rounded leading end 21*c* has a greater thickness than that of the flange body 21*b* and has a thick rounded shape.

The conductive support portion 89 is formed from, for example, a conductive material such as Kovar metal.

Figure 6:
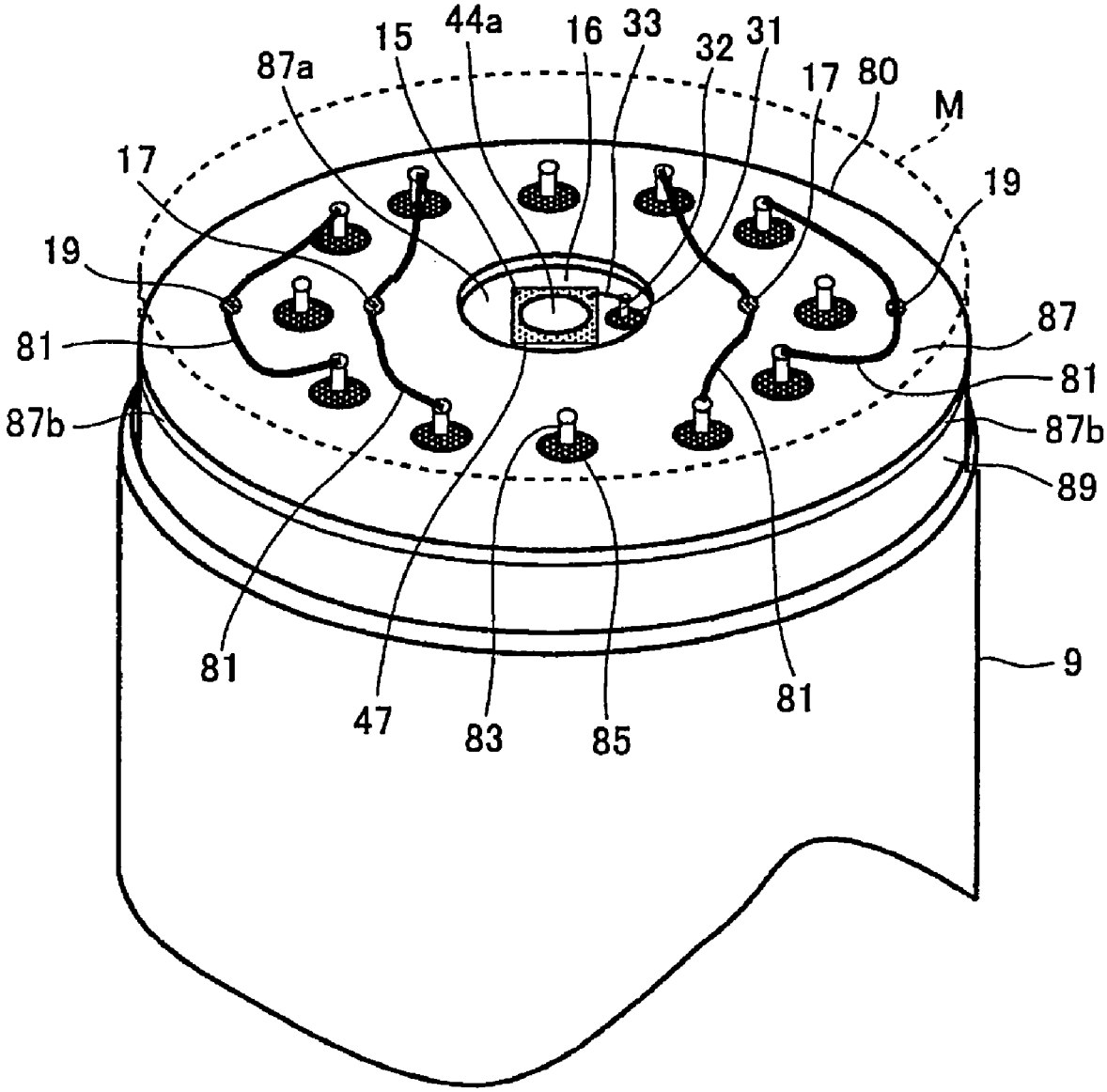
FIG. 6 is a perspective view schematically showing the electron detection section head portion when a shield portion is not provided.

The inner stem 80 includes an APD stem 16 and a base 87. The base 87 is formed from a conductive material. The base 87 has substantially an annular shape with its center located on the axis Z of the envelope 2. The outer circumference on the lower side surface of the base 87 is fixed to the upper end of the conductive support portion 89. A through-hole 87*a* is formed in the center of the base 87. The through-hole 87*a* has a circular shape with its center located on the axis Z. The base 87 has an outer periphery 87*b* circumferentially extending around the axis Z. The outer periphery 87*b* defines the outer periphery of the inner stem 80. As shown in FIGS. 3 and 6, the imaginary extended curved surface M of the outer periphery 87*b* extends from the outer periphery 87*b* in the upper direction of FIG. 3 in parallel to the axis Z. Accordingly, as shown in FIG. 1, the imaginary extended curved surface M of the outer periphery 87*b* extends from the outer periphery 87*b* toward the upper hemisphere 4*a* (photocathode 11) in parallel to the axis Z.

The APD stem 16 is fixed to the lower side of the base 87 so as to air-tightly close the through-hole 87*a*. The APD stem 16 has a disc shape with its center located on the axis Z, and is formed from a conductive material.

The APD 15 is disposed on the APD stem 16 at a position on the axis Z and faces the upper hemisphere 4*a* (photocathode 11). Thus, the APD 15 is fixed at substantially the center position of the inner stem 80.

Twelve electrodes 83 (FIG. 6) are arranged on the base 87 around the through-hole 87*a*. Only two electrodes 83 are shown in FIG. 3. The respective electrodes 83 penetrate the base 87. Each of the electrodes 83 is electrically insulated from the base 87 by an insulating material 85 such as glass and is air-tightly sealed thereby.

The two manganese beads 17 are symmetrically disposed with respect to the axis Z. The antimony beads 19 are disposed outside the manganese beads 17. The two antimony beads 19 are symmetrically disposed with respect to the axis Z. The manganese beads 17 and antimony beads 19 are held by wire heaters 81 (see FIGS. 4 and 6), respectively. Each of the wire heaters 81 is connected to corresponding two electrodes 83 (see FIG. 6) among the twelve electrodes.

As can be seen from FIGS. 1, 3, 4, and 6, the manganese beads 17 and antimony beads 19 are located on the upper side relative to the inner stem 80 (more specifically, the base 87) and disposed on the inner side relative to the imaginary extended curved surface M of the outer periphery 87*b* of the base 87.

The shield portion 70 is provided to cover the inner stem 80.

As shown in FIGS. 3 and 4, the shield portion 70 includes a cap 73 and a cover 71. The cap 73 and cover 71 are formed from conductive material. The cap 73 has a circular cap shape with its central axis located on the axis Z. The cap 73 has an inner wall 72, an outer wall 74, and a ceiling 76 that connects the inner wall 72 and outer wall 74. The inner wall 72 and outer wall 74 are of concentric tube shapes with their axis being located on the central axis Z and extend toward the upper hemisphere 4*a* (photocathode 11) substantially in parallel to the axis Z, as shown in FIGS. 1 and 3. As shown in FIGS. 1 and 3, the outer wall 74 extends from the base 87 substantially along the imaginary extended curved surface M of the outer periphery 87*b* of the base 87 toward the photocathode 11. A through-hole 73*a* is formed in the center of the ceiling 76. The through-hole 73*a* has a circular shape having a central axis located on the axis Z. Two through-holes 75 are formed in the ceiling 76 at locations outside the through-hole 73*a*. Each of the two through-holes 75 has a circular shape. The two through-holes 75 are symmetrically disposed with respect to the through-hole 73*a*. Two through-holes 77 are formed in the ceiling 76 at locations outside the two through-holes 75. Each of the two through-holes 77 has also a circular shape. The two through-holes 77 are symmetrically disposed with respect to the through-hole 73*a*. Each of the manganese beads 17 held by the wire heater 81 is located within the through-hole 75. Each of the antimony beads 19 held by the wire heater 81 is located within the through-hole 77.

The cover 71 is disposed within the through-hole 73*a* of the cap 73. The cover 71 has a circular cap shape having a central axis coinciding with the axis Z. The cover 71 has an outer wall 71*a* and a ceiling 71*b*. The outer wall 71*a* has a cylindrical shape having a central axis coinciding with the axis Z and extends toward the upper hemisphere 4*a* (photocathode 11) substantially in parallel to the axis Z, as shown in FIGS. 1 and 3. The outer periphery of the cover 71 (i.e., outer wall 71*a*) is connected to the inner wall 72 of the cap 73. A through-hole 79 is formed in the ceiling 71*b* of the cover 71. The through-hole 79 has a circular shape having a central axis coinciding with the axis Z. The cover 71 is located above the APD 15.

The cover 71 and inner wall 72 isolate the APD 15 from the manganese beads 17 and antimony beads 19. The outer wall 74 surrounds the manganese beads 17 and antimony beads 19.

As described above, in the embodiment of the present invention, the manganese beads 17 and antimony beads 19 are disposed at portions on the upper hemisphere 4*a* side relative to the base 87 and between the imaginary extended curved surface M of the outer periphery 87*b* of the base 87 and outer wall 71*a* of the cover 71. That is, the manganese beads 17 and antimony beads 19 are disposed at positions that are outside the outer wall 71*a* of the cover 71, and inside the imaginary extended curved surface M of the outer periphery 87*b* of the base 87. That is, the manganese beads 17 and the antimony beads 19 are disposed at positions that are further away from the axis Z than the outer wall 71*a*. And the manganese beads 17 and the antimony beads 19 are disposed at the positions that are near to the axis Z than the imaginary extended curved surface M. Therefore, as described later, the base 87, the ceiling 76 of the cap 73, and the outer wall 74 allow the manganese vapor and antimony vapor to be deposited in substantially the entire area of the internal surface of the upper hemisphere 4*a* around the axis Z, while preventing manganese vapor and antimony vapor from being adhered to the glass bulb base 5, lower hemisphere 4*b*, and internal surface of the outer stem 6. Therefore, a base film of the photocathode 11 can be formed in substantially the entire internal surface of the upper hemisphere 4*a*. In addition, the cover 71 can prevent the manganese vapor and antimony vapor from being adhered to the APD 15.

A pin 30 is fixed on the lower surface of the APD stem 16. The pin 30 is electrically connected to the APD stem 16. A pin 32 penetrates the APD stem 16. The pin 32 is electrically insulated from the APD stem 16 and air-tightly sealed by an insulating material 31 such as glass.

The electrical circuit 90 has capacitors C1, C2, an amplifier A1, output terminals N1, N2, and input terminals N3, N4. The pin 30 and one terminal of the capacitor C1 are connected to the input terminal N3. The other terminal of the capacitor C1 is connected to the output terminal N1. The pin 32 and one terminal of the capacitor C2 are connected to the input terminal N4. The other terminal of the capacitor C2 is connected to the output terminal N2 through the amplifier A1. The input terminals N3 and N4 are connected to the external power supply (not shown). The output terminals N1 and N2 are connected to the external circuit 100. The external circuit 100 has a resistor R. The external circuit 100 grounds the output terminal N1. The resistor R is connected between the output terminals N1 and N2.

Next, the configuration of the APD 15 will be described with reference to FIG. 5.

Figure 5:
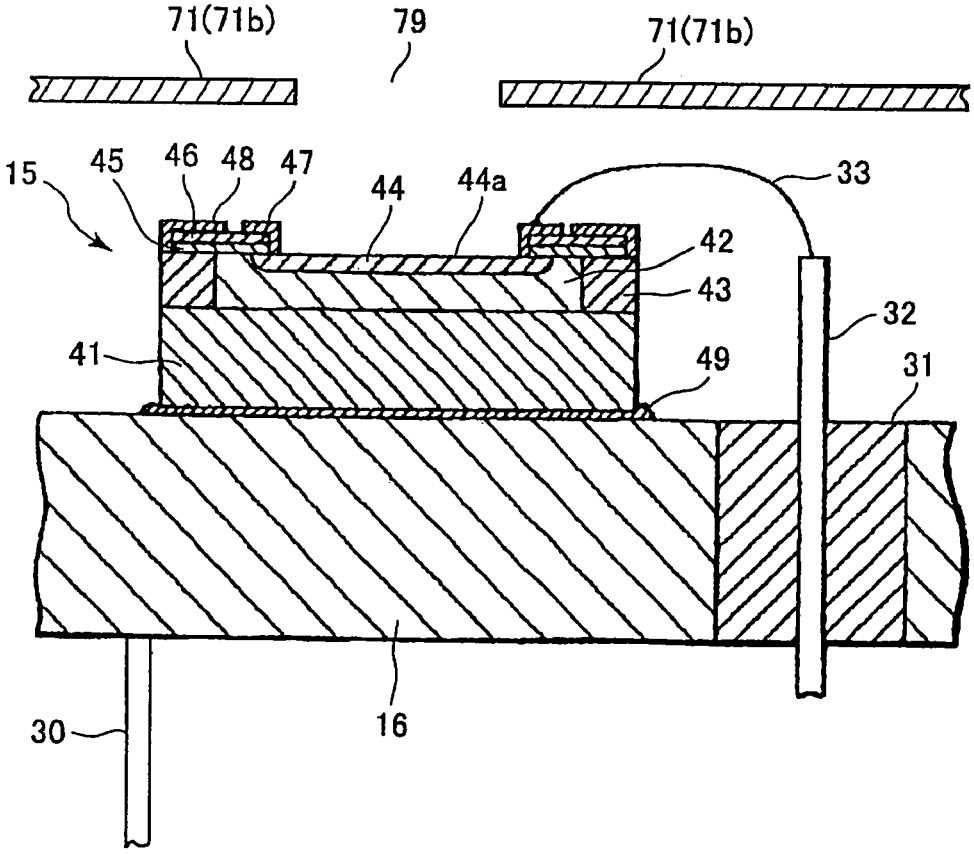
FIG. 5 is a cross-sectional view schematically showing an APD in the electron detection section.

As shown in FIG. 5, the APD 15 is disposed on the APD stem 16 so as to face the opening section 79 of the cover 71. The APD 15 is fixed to the APD stem 16 by a conductive adhesive 49.

The APD 15 has substantially a square plate-shaped n-type high concentration silicon substrate 41 and a disc-shaped p-type carrier multiplication layer 42 formed on the high concentration silicon substrate 41 at substantially the center thereof. A guard ring layer 43 is formed around the outer periphery of the carrier multiplication layer 42. The guard ring layer 43 has the same thickness as that of the carrier multiplication layer 42 and is composed of a high concentration n-type layer. A breakdown voltage control layer 44 composed of a high concentration p-type layer is formed on the surface of the carrier multiplication layer 42. The surface of the breakdown voltage control layer 44 is formed as a circular electron incident surface 44*a*. An oxide film 45 and a nitride film 46 are formed so as to extend from the guard ring layer 43 to the area surrounding the breakdown voltage control layer 44.

An incident surface electrode 47 is formed on the outermost surface of the APD 15 by depositing aluminum in an annular shape onto the surface thereof. The incident surface electrode 47 is for supplying the breakdown voltage control layer 44 with an anode potential. A surrounding electrode 48 is formed also on the outermost surface of the APD 15. The surrounding electrode 48 is electrically conducted to the guard ring layer 43. The surrounding electrode 48 is spaced apart from the incident surface electrode 47 with a predetermined distance.

The high concentration n-type silicon substrate 41 is electrically conducted to the APD stem 16 through the conductive adhesive 49. Accordingly, the high concentration n-type silicon substrate 41 is electrically conducted to the pin 30. The incident surface electrode 47 is connected to the penetration pin 32 by a wire 33.

FIG. 6 shows a state where the shield portion 70 has been removed from the electron detection section head portion 8 and, further, the conductive flange 21 has been removed from the insulating tube 9 and conductive support portion 89. The conductive support portion 89 is disposed on the upper portion of the insulating tube 9. The inner stem 80 is disposed on the upper portion of the conductive support portion 89. The inner stem 80 has the base 87. The APD stem 16 is exposed through the through-hole 87*a* formed in the base 87.

The APD 15 is disposed on the APD stem 16. The APD 15 has the electron incident surface 44*a* that faces upward. The pin 32 is fixed to the APD stem 16. The pin 32 is electrically insulated from the APD stem 16 by the insulating material 31. The APD 15 is connected to the pin 32 by the wire 33.

The twelve electrodes 83 are fixed to the base 87. Each of the electrodes 83 is insulated from the base 87 by the insulating material 85. The twelve electrodes 83 are circumferentially arranged around the through-hole 87*a*. Four pairs of electrodes 83 are connected by the wire heaters 81. Each of the wire heaters 81 holds the manganese bead 17 or antimony bead 19. The manganese bead 17 and antimony bead 19 have bead-like shapes.

Figure 7:
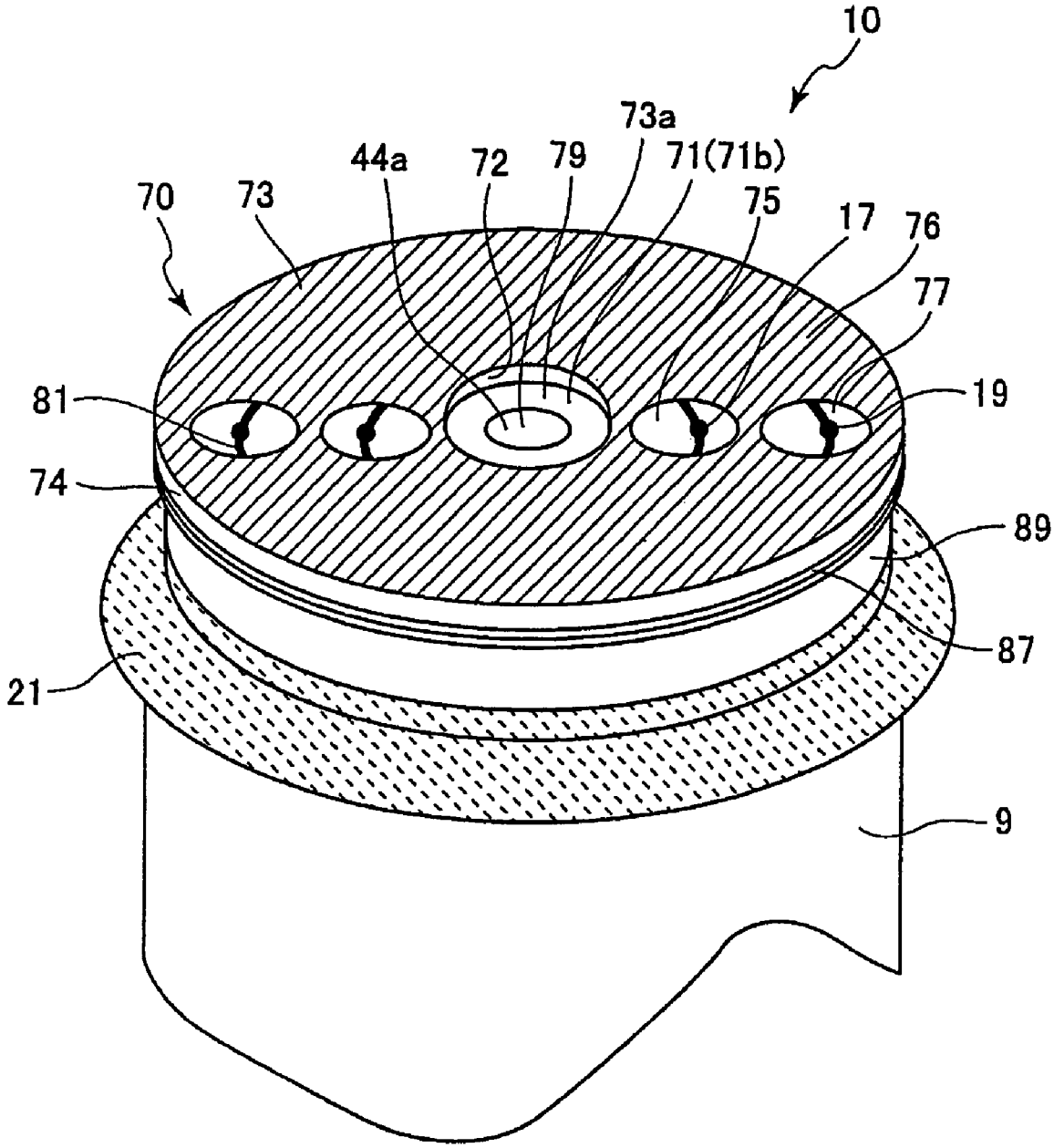
FIG. 7 is a perspective view schematically showing the electron detection section head portion.

FIG. 7 shows a state where the conductive flange 21 and shield portion 70 have been attached to the electron detection section head portion 8 of FIG. 6. The conductive flange 21 is fixed to the upper end of the insulating tube 9 and is connected to both the insulating tube 9 and conductive support portion 89. The conductive flange 21 extends in the direction away from the insulating tube 9.

The cap 73 of the shield portion 70 covers the base 87 from above. The cap 73, which is formed into a circular shape, has the inner wall 72, outer wall 74, and ceiling 76. The circular through-hole 73*a*, two through-holes 75, and two through-holes 77 are formed in the ceiling 76. The manganese beads 17 held by the wire heaters 81 are exposed through through-holes 75. The antimony beads 19 held by the wire heaters 81 are exposed through through-holes 77. The electron incident surface 44*a* of the APD 15 is exposed through the through-hole 79 formed on the cover 71. The cover 71 and inner wall 72 isolate the APD 15 from the manganese beads 17 and antimony beads 19. The outer wall 74 surrounds the manganese beads 17 and antimony beads 19.

Figure 8A:
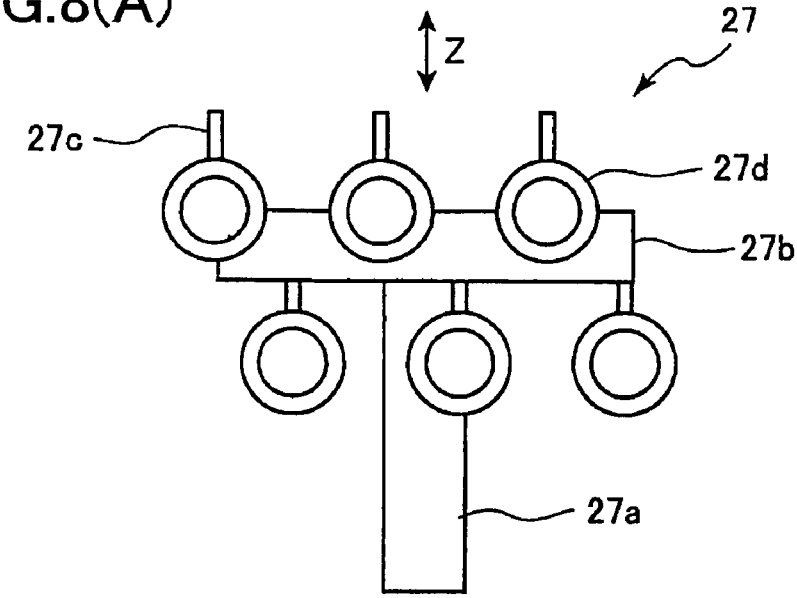
FIG. 8 (A) and FIG. 8 (B) are views showing an alkali source, wherein FIG. 8 (A) is a front view of the alkali source, and FIG. 8 (B) is a schematic perspective view of the alkali source.
Figure 8B:
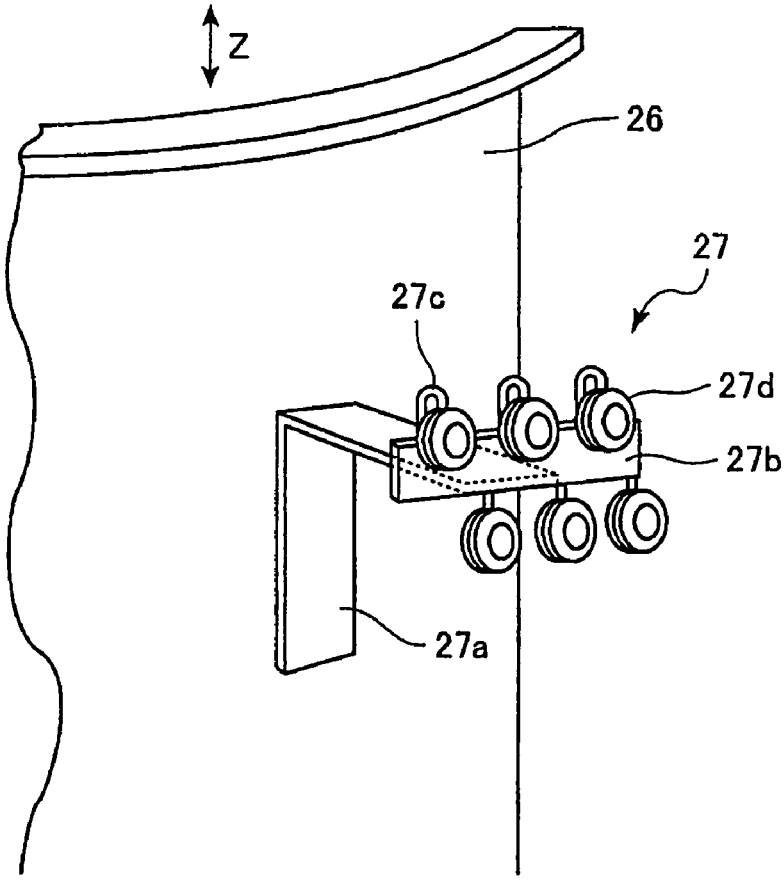

The configuration of the alkali source 27 will next be described with reference to FIG. 1 and FIGS. 8 (A) and 8 (B). FIG. 8 (A) is a front view of the alkali source 27 provided outside the partition wall 26 as viewed from the glass bulb base 5 side. FIG. 8 (B) is a perspective view of the alkali source 27.

The support portion 27*a* is formed into an L-like shape having a part extending in parallel to the axis Z and a part extending away from the axis Z in the radial direction. The support portion 27*a* is, for example, a stainless steel ribbon (SUS ribbon). The part that extends in parallel to the axis Z is fixed to the outer surface of the partition wall 26.

The holding plate 27*b* is fixed to a tip end of a part of a support portion 27*a* that extends in the direction away from the axis Z. The holding plate 27*b* extends in perpendicular to the axis Z and substantially in parallel to the circumferential direction of the cylindrical partition wall 26.

The six attachment portions 27*b* are fixed to the holding plate 27*b*. The containers 27*d* are fixed respectively to the tip ends of the attachment portions 27*b*. The container 27*d* has an opening on its side surface. Alkali source pellets (not shown) are contained inside five containers 27*d*. A getter (not shown) is contained inside the remaining one container 27*d* among the six containers 27*d*. The getter is a material that absorbs impurity such as barium or titanium.

As shown in FIG. 1, the two alkali sources 27 are disposed in the electron tube 1. Potassium (K) pellets are contained, as alkali source pellets, in five containers 27*d* provided in one alkali source 27. Cesium (Cs) pellets are contained, as alkali source pellets, in five containers 27*d* provided in the other alkali source 27.

A method of manufacturing the electron tube 1 having the configuration described above will next be described.

Firstly, the glass bulb 3 is prepared by air-tightly connecting the stem outer wall 62 to the lower hemisphere 4*b*, with the conductive thin film 13 being deposited on the inner surface of the lower hemisphere 4*b*.

Further, the stem bottom 60 is prepared with the partition wall 26 and the connection electrode 12 fixed thereto and with the exhaust pipe 7 connected thereto. The two alkali sources 27 and 27 are fixed to the partition wall 26. The glass tube 63 is connected to the exhaust pipe 7. At this time, the length of the glass tube 63 is larger than that in a state of FIG. 1. Not only the end portion of the glass tube 63 that is connected to the exhaust pipe 7, but also the opposite end of the glass tube 63 is opened.

Then, the insulating tube 9 is air-tightly connected to the conductive support portion 89 of the electron detection section head portion 8. The conductive flange 21 is connected to the conductive support portion 89 and insulating tube 9. The insulating tube 9 is air-tightly connected to the stem inner wall 61. The conductive flange 23 is connected to the insulating tube 9 and stem inner wall 61.

Then, the stem inner wall 61 is air-tightly connected to the stem bottom 60 by laser welding. The stem outer wall 62 is air-tightly connected to the stem bottom 60 by plasma welding. As a result, the electron tube 1 is obtained with the electron detection section 10 protruding inside the envelope 2.

Next, the photocathode 11 is formed on the internal surface of the lower hemisphere 4*a* of the glass bulb 3 as described below.

Firstly, an exhaust device (not shown) is connected to the glass tube 63 and the inside of the envelope 2 is exhausted through the glass tube 63 and exhaust pipe 7. As a result, the inside of the electron tube 1 is set at a predetermined degree of vacuum.

Subsequently, the wire heaters 81 are energized through the electrodes 83 to heat the manganese beads 17 and antimony beads 19. To the electrodes 83, an electrical power is supplied from a power source (not shown). The heated manganese beads 17 and antimony beads 19 generate metal vapor. The generated vapor of the manganese and antimony is deposited on the inner surface of the upper hemisphere 4*a* to form a base film of the photocathode 11.

At this time, the cover 71, inner wall 72, and outer wall 74 prevent the metal from being deposited on the APD 15 or unintended area of the inner surface of the envelope 2 (to be more specific, the internal surface of the lower hemisphere 4*b*, glass bulb base 5, or outer stem 6). That is, the cover 71 and inner wall 72 are disposed near the APD 15 so as to surround the APD 15. Therefore, although the cover 71 and inner wall 72 have simple tubular shapes and are small members, they can effectively isolate the APD 15 from the manganese beads 17 and antimony beads 19. Therefore, characteristics of the APD 15 can be prevented from being degraded due to adhesion of the metal vapor to the APD 15.

The outer wall 74 surrounds the manganese beads 17 and antimony beads 19. Therefore, the outer wall 74 can prevent the metal vapor from being deposited on the lower hemisphere 4*b*, glass bulb base 5, and internal surface of the outer stem 6.

The manganese beads 17 and antimony beads 19 are disposed, adjacently to the APD 15, around the APD 15 that is located at substantially the center of the inner stem 80. Therefore, the manganese and antimony can be deposited over a wide area on the internal surface of the upper hemisphere 4*a*.

Next, the alkali sources 27, 27 are inductively heated from the outside of the envelope 2 by electromagnetic induction. Then, the potassium (K) and cesium (Cs) pellets are heated to generate vapor from the openings of the respective containers 27*d*. The potassium and cesium are deposited on the inner surface of the upper hemisphere 4*a*. Consequently, the potassium, cesium, manganese, and antimony are reacted on the internal surface of the upper hemisphere 4*a* to form the photocathode 11.

The partition wall 26 isolates the alkali sources 27, 27 from the electron detection section 10. This prevents the potassium and cesium from being adhered to the insulating tube 9 to thereby prevent a decrease in work function of the surface of the insulating tube 9, resulting in prevention of a reduction in voltage resistance or adverse influence on the electrical field in the electron tube 1. Further, the potassium and cesium can be prevented from being adhered to the APD 15 to thereby prevent a decrease in detection efficiency of the electron. The getter absorbs the impurity within the envelope 2 and helps keep the degree of vacuum at an appropriate level.

Thus, the photocathode 11 is formed on the entire inner surface of the upper hemisphere 4*a*.

Next, the glass tube 63 is removed from the exhaust device (not shown) and the end portion 65 thereof is air-tightly sealed immediately.

The electron tube 1 is manufactured in the process described above.

Operation of the electron tube 1 will next be described.

The outer stem 6 is grounded. As a result, a ground voltage is applied to the photocathode 11 through the connection electrode 12 and conductive thin film 13.

A voltage of, for example, 20 KV is applied to the input terminal N4 of the electrical circuit 90. As a result, a voltage of 20 KV is applied to the breakdown voltage control layer 44 of the APD 15, i.e., the electron incident surface 44*a* of the APD 15 through the pin 32.

A voltage of, for example, 20.3 KV is applied to the input terminal N3 of the electrical circuit 90. As a result, a reverse-bias voltage of 20.3 KV is applied to the APD stem 16, base 87, and conductive support portion 89 through the pin 30.

The insulating tube 9 electrically insulates from each other the conductive support portion 89, to which a positive high voltage is applied, and the outer stem 6 that is grounded. Accordingly, the envelope 2 and APD 15 are electrically insulated from each other, preventing a high voltage from being exposed to the outside environment.

Therefore, handling of the electron tube 1 becomes easier. Further, occurrence of discharge between the electron tube 1 and outside environment can be prevented. As a result, the electron tube 1 can be used even in water.

The APD 15 is provided on the inner stem 80, which is disposed on the tip end of the insulating tube 9 that protrudes inside the envelope 2. That is, the APD 15 is electrically insulated from the envelope 2 at the position that is distant from the envelope 2. Therefore, the electrical field inside the envelope 2 is not disturbed. As a result, electrons emitted from the electrical surface 11 can be efficiently converged onto the APD 15 and enter the APD 15.

If the insulating tube 9 does not protrude inside the envelope 2, a part of the envelope 2 has to be formed by an insulating material in order to insulate the APD 15 from the envelope 2. In the embodiment of the present invention, however, the insulating tube 9 is disposed protruding the inside the envelope 2, so that it is not necessary to insulate the APD 15 and envelope 2 from each other at a portion of the envelope 2. Therefore, the photocathode 11 can be widely formed on the inner surface of the envelope 2, thereby increasing light detection sensitivity.

When light enters the photocathode 11 of the electron tube 1, the photocathode 11 emits electrons in response to the incident light. Hereinafter, trajectories L of electrons in the envelope 2 will be described below in greater detail with reference to FIG. 9.

Figure 9:
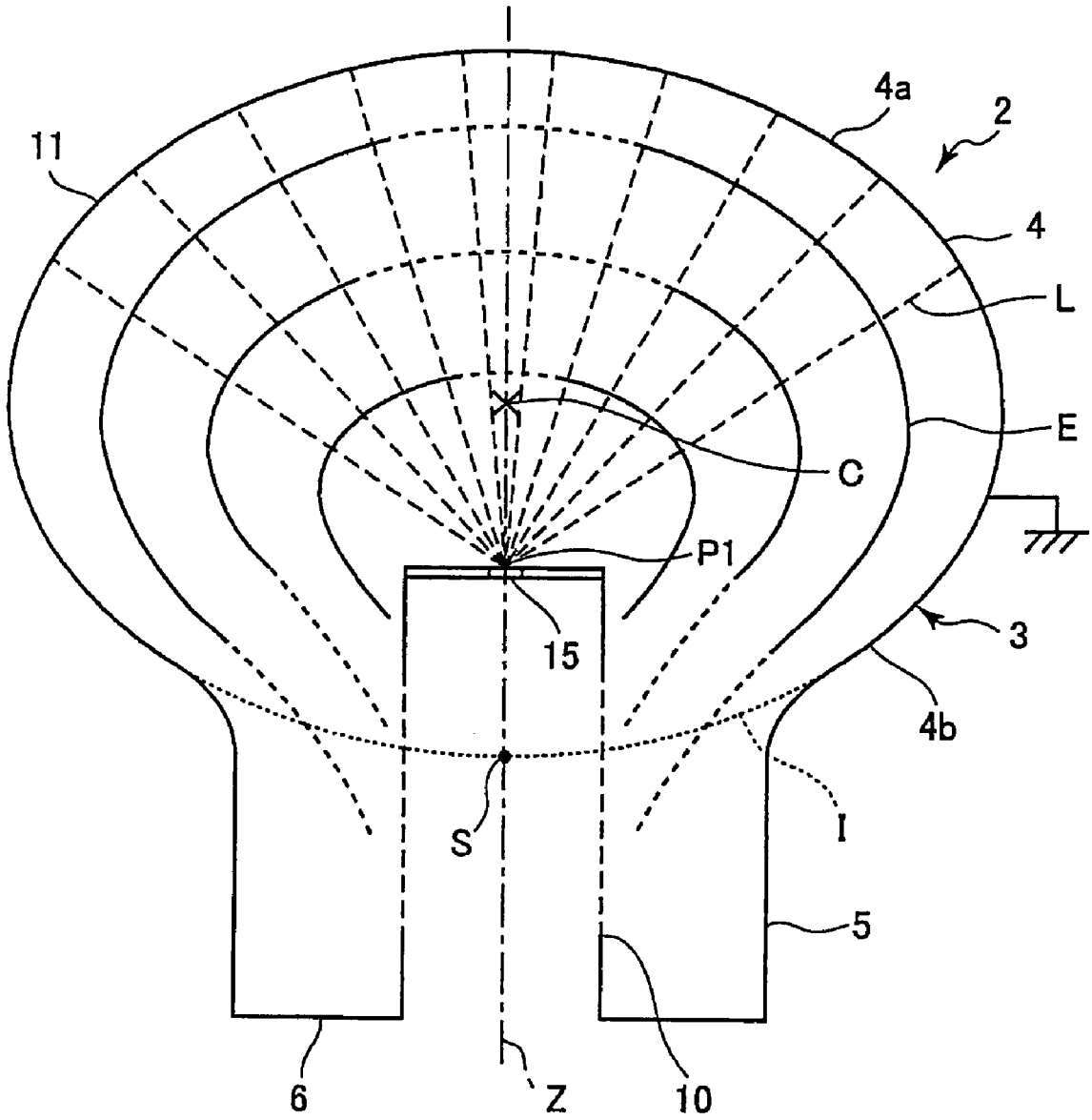
FIG. 9 is a vertical cross-sectional view schematically showing equipotential surfaces E and electron trajectories L in the electron tube.

As shown in FIG. 9, the APD 15 is disposed on the glass bulb body 4 side (i.e., upper side in FIG. 9) relative to the reference point S. A point c denotes the center of the glass bulb body 4.

In this case, concentric spherical equipotential surfaces E are generated by a potential difference between the envelope 2 and the electron incident surface 44*a* of the APD 15. Thus, electrons emitted from the photocathode 11 fly along the trajectories L in FIG. 9. Therefore, the electrons emitted from the photocathode 11 are converged on a point P1 near the upper surface of the APD 15, which is located slightly below the point c.

The APD 15 is disposed on the glass bulb body 4 side relative to the reference point S. More specifically, the APD 15 is disposed at the point P1 which is a convergent point of the electrons. Accordingly electrons emitted from the photocathode 11, which has substantially the hemispherical shape and which has a wide effective area, can be converged onto a narrow area. As a result, the electrons, which are emitted from the photocathode 11 having a wide effective area, can efficiently enter the APD 15 having a small effective area, thereby increasing detection efficiency.

Figure 10:
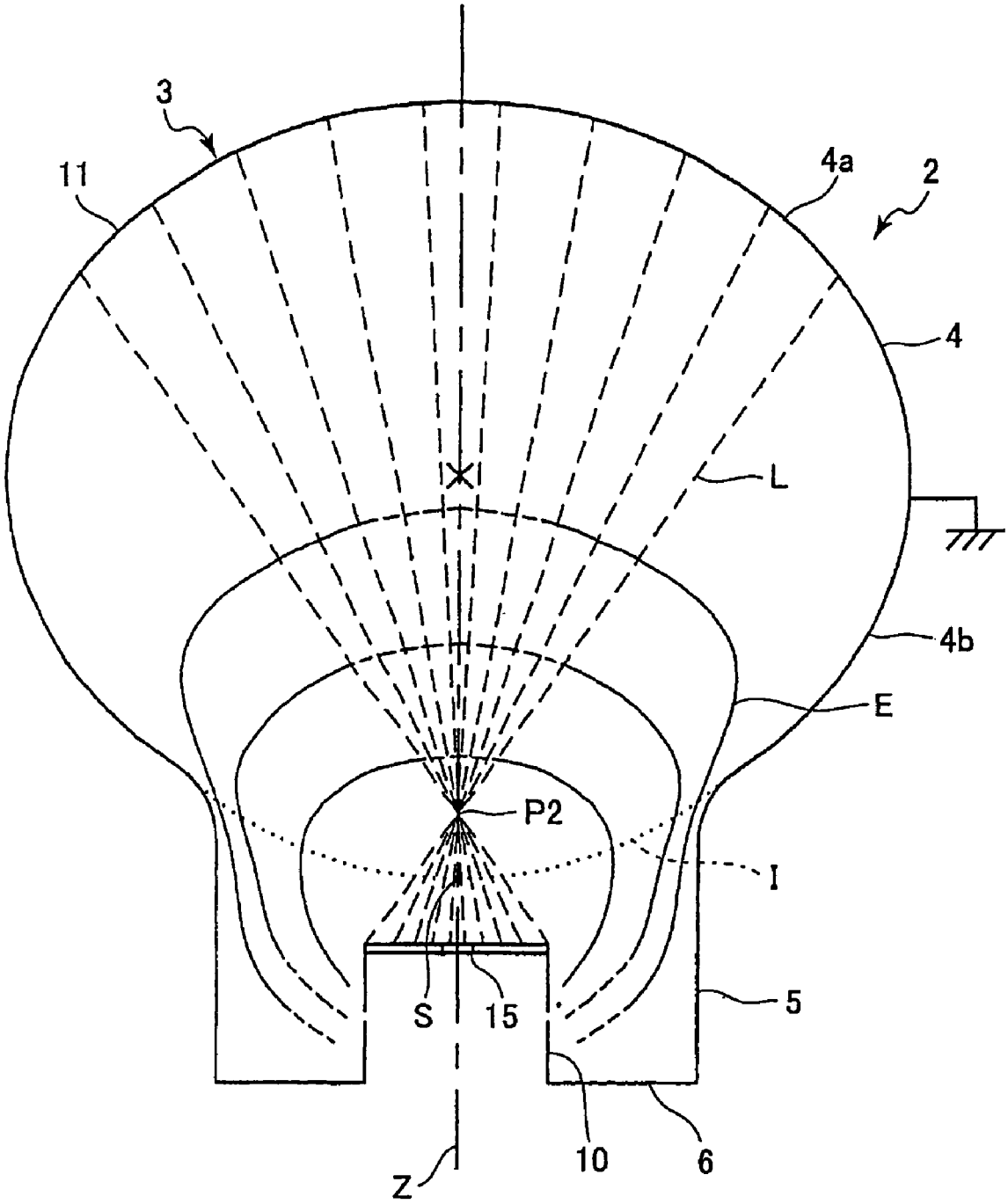
FIG. 10 is a vertical cross-sectional view schematically showing equipotential surfaces E and electron trajectories L in an electron tube of a comparative example.

Assume here, as a comparison example, that the APD 15 is disposed on the lower side relative to the reference point S in the glass bulb base 5. In this case, the equipotential surfaces E are generated as shown in FIG. 10 by a potential difference between the envelope 2 and the APD 15. Electrons are emitted from the photocathode 11 along trajectories L of FIG. 10. As a result, the electrons from the photocathode 11 are converged on a point P2. The electrons diffuse at the position of the APD 15, as shown in FIG. 10. Therefore, the electrons emitted from the photocathode 11 may not enter the APD 15 efficiently.

In the embodiment of the present invention, the APD 15 is covered by the cover 71. As a result, the incident direction of the electron is further restricted to thereby further increase electron detection sensitivity of the APD 15.

Further, the upper end of the partition wall 26 is located on the lower side relative to the imaginary extended curved surface I and, accordingly, does not protrude on the glass bulb body 4 side. Further, the upper end of the partition wall 26 is located on the lower side relative to the APD 15. Therefore, the electrical field in the glass bulb body 4 can be prevented from being disturbed by the partition wall 26.

In addition, the APD 15 has high-speed response, has small leak current, and can be produced with a low manufacturing cost due to a small number of manufacturing components.

Figure 11:
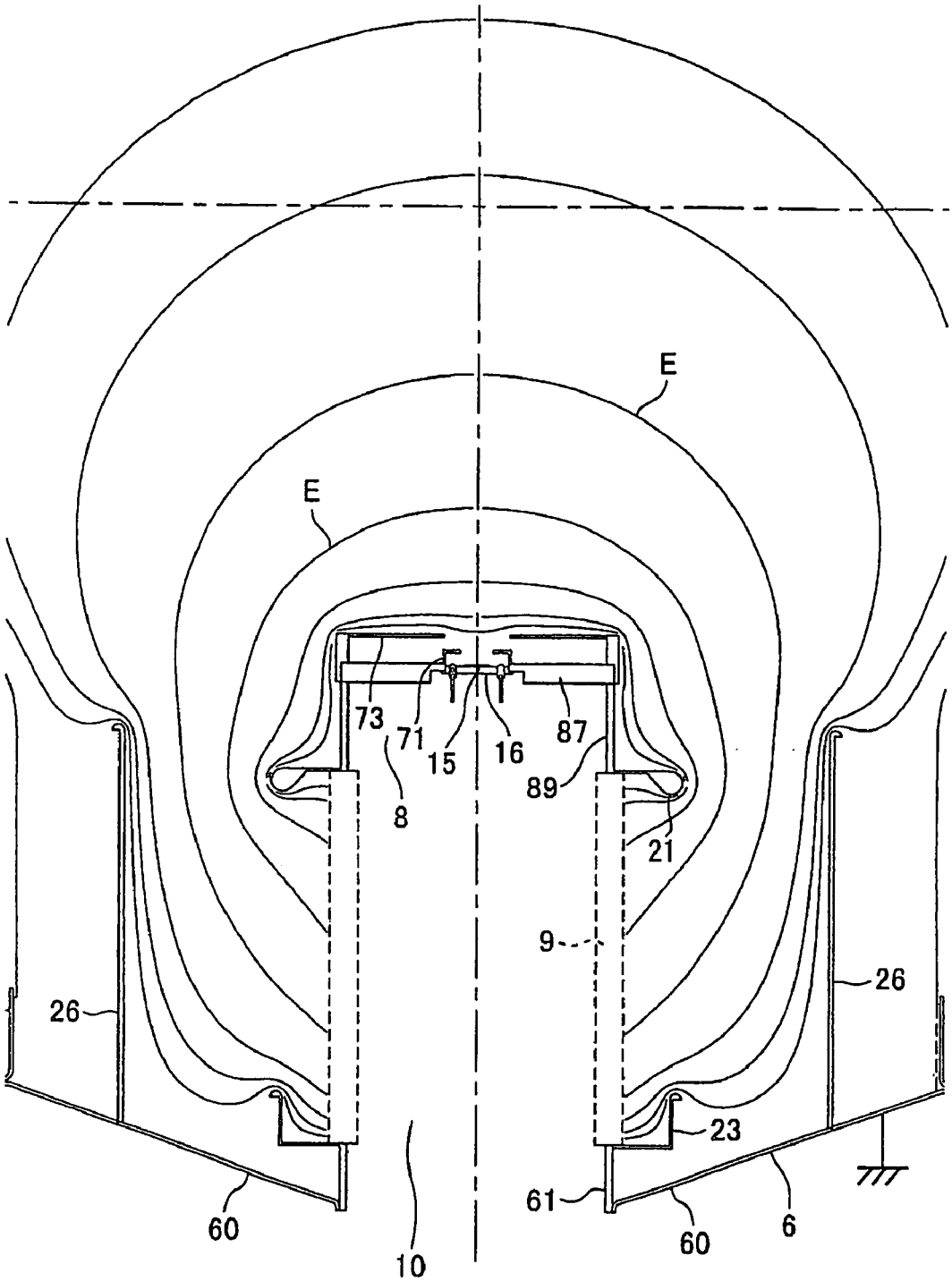
FIG. 11 is a vertical cross-sectional view schematically showing equipotential surfaces E generated in the vicinity of upper and lower end portions of an insulating tube 9 by conductive flanges 21 and 23.

Effects of the conductive flanges 21 and 23 will next be described with reference to FIG. 11.

The upper end portion of the insulating tube 9 is connected to the conductive support portion 89, to which a positive high voltage is applied. On the other hand, the lower end portion of the insulating tube 9 is connected to the stem inner wall 61 connected to the ground. In the embodiment of the present invention, the conductive flange 21 is provided at the connection portion between the upper end portion of the insulating tube 9 and conductive support portion 89, and the conductive flange 23 is provided at the connection portion between the lower end portion of the insulating tube 9 and conductive stem inner wall 61. This configuration can reduce the potential gradient in the vicinity of the connection portions between the insulating tube 9 and conductive support portion 89 and between the insulating tube 9 and stem inner wall 61. Therefore, this construction can prevent concentration of the equipotential surfaces and prevent the potential gradient from being increased. This construction can also prevent the concentric spherical equipotential surfaces E from being distorted in the vicinity of the upper and lower portions of the insulating tube 9. Electrons emitted from the photocathode 11 can efficiently enter the APD 15. Light that has entered the photocathode 11, can be detected with high sensitivity. Further, the reduction in the potential gradient reduces the electric field intensity, thereby preventing discharge from occurring at the upper and lower end portions of the insulating tube 9. Therefore, a large potential difference can be applied between the envelope 2 and APD 15, further increasing detection sensitivity.

Further, the tip end portions 21*c* and 23*d* of the conductive flanges 21 and 23 have thicker cross-sections than the cross-sections of other portions thereof and have curved surfaces. Therefore, the electrical field is prevented from concentrating on the tip ends of the conductive flanges 21 and 23.

As described above, the potential gradient in the vicinity of the upper and lower portions of the insulating tube 9 is reduced by the conductive flanges 21 and 23 and, thereby, the substantially concentric spherical equipotential surfaces are formed in the electron tube 1. Thus, even if an electron emitted from the photocathode 11 is reflected by the APD 15, this reflected electron can enter the APD 15 once again, minimizing degradation in detection efficiency which will possibly be caused by the reflected electron. Further, the equipotential surfaces have substantially the concentric spherical shapes, so that the electrons emitted from any position of the photoelectrical surface 11 enter the APD 15 at substantially the same time. Therefore, the incident time of the incident light on the photocathode 11 can accurately be measured irrespective of the incident position.

Figure 12:
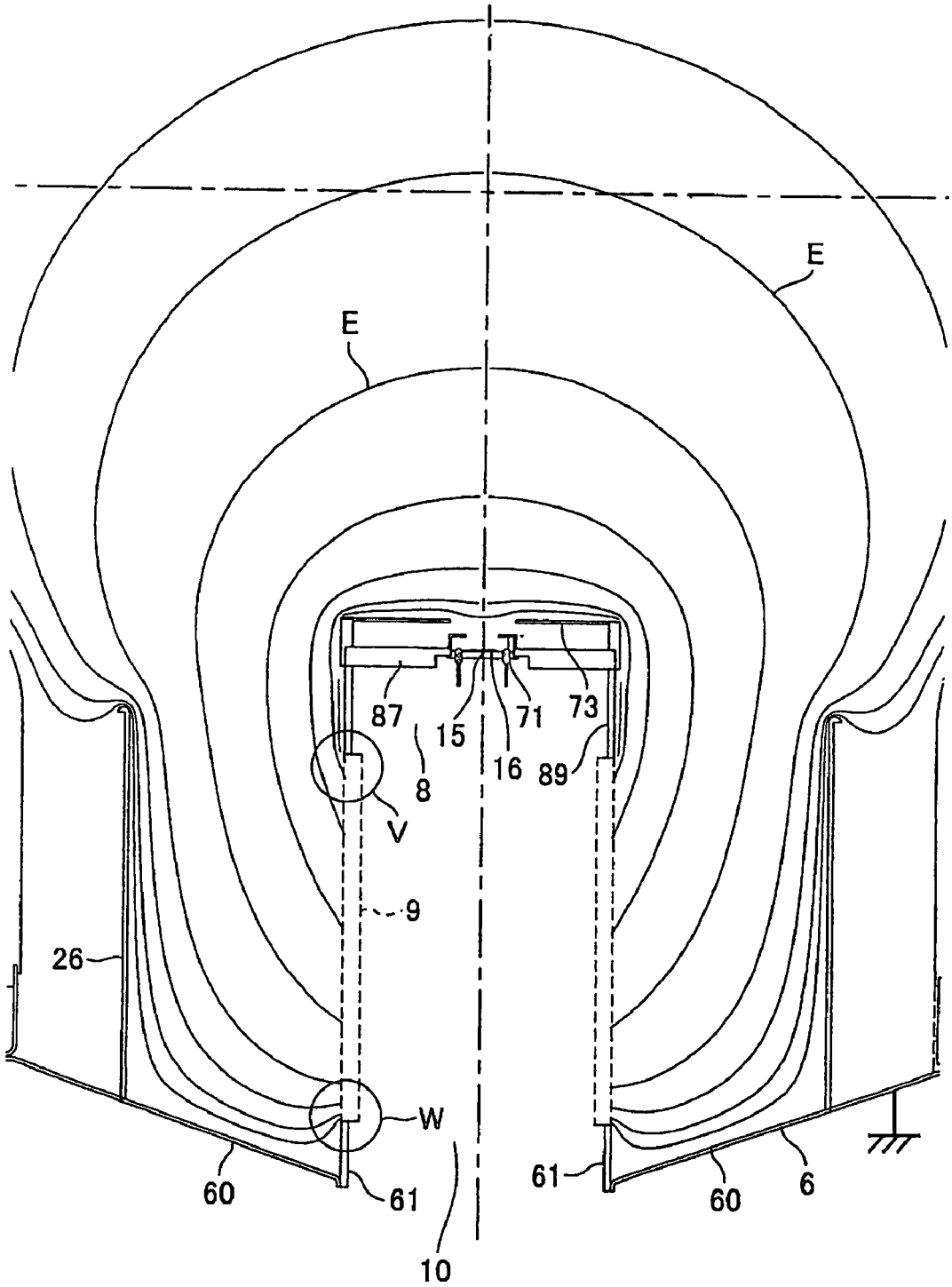
FIG. 12 is a vertical cross-sectional view schematically showing equipotential surfaces E generated in the vicinity of upper and lower end portions of an insulating tube 9 when the conductive flange 21 or 23 is not provided.

If the conductive flanges 21 and 23 are not provided, as shown in FIG. 12, a plurality of equipotential surfaces E concentrate on an area V in the vicinity of the upper end portion of the insulating tube 9 and an area W in the vicinity of the lower end portion of the insulating tube 9 to generate a large potential gradient. Therefore, electrons emitted from the photocathode 11 are disturbed in the areas V and W to prevent the electrons from efficiently entering the APD 15, resulting in a decrease in sensitivity and an increase in noise. Further, since there is a possibility that discharge may occur in the vicinity of the areas V and W, a large potential difference cannot be applied between the envelope 2 and the APD 15.

After entering the APD 15, the electrons from the photocathode 11 have lost energy in the APD 15 and, at this time, generate a large number of electron-hole pairs. Further, the electrons are multiplied by avalanche multiplication. As a result, the electrons in the APD 15 are multiplied by about $10^5$ in total.

The multiplied electrons are outputted as detection signals through the pin 32. Low frequency components are then removed from the detection signals by the capacitor C2, and only pulse signals caused by the incident electrons are inputted to the amplifier A1. The amplifier A1 amplifies the pulse signals. The pin 30 is AC-connected to the output terminal N1 through the capacitor C1, and grounded. Therefore, the external circuit 100 can accurately detect the amount of the electrons that have entered the APD 15 as a potential difference generated in the resistance R connected between the output terminals N1 and N2.

The capacitors C1 and C2 in the insulating tube 9 are located near the APD 15. Therefore, the capacitors C1 and C2 can supply the external circuit 100 with low noise output signals from which direct current components have been removed, without impairing response of the signals outputted from the APD 15.

As described above, according to the electron tube 1 of the embodiment of the present invention, even if a ground voltage is applied to the envelope 2 and a positive high voltage is applied to the APD 15, the voltage applied to the connection portion between the insulating tube 9 and outer stem 6 can be set to the ground voltage, preventing a high voltage from being exposed to the outside environment. Therefore, the electron tube 1 can easily be handled and occurrence of discharge between the envelope 2 and outside environment can be prevented. Further, the electron tube 1 can be used in water and can be used, for example, in water Cerenkov experiment.

The photocathode 11 is formed on a predetermined portion of the glass bulb body 4 having a curved surface which has substantially a spherical shape, so that the photocathode 11 can widely be formed. The APD 15 is provided on the glass bulb body 4 side relative to the reference point S in the glass bulb base 5, allowing the electrons emitted from the photocathode 11 having a wide effective area to be converged on the APD 15 having a small effective area. As a result, the generated electrons are converged on and enter the semiconductor device 15 in an efficient manner, thereby increasing electron detection sensitivity. Further, since the APD 15 has a small effective area, the APD 15 has high-speed response, small leak current, and can be produced with a low manufacturing cost.

The alkali source 27 and insulating tube 9 are isolated from each other by the partition wall 26. Therefore, when the alkali source 27 generates alkali metal vapor to form the photocathode 11 on the predetermined portion of the envelope 2, the alkali metal can be prevented from being deposited on the insulating tube 9. By preventing the alkali metal from being adhered to the insulating tube 9, this construction can prevent the adhered alkali metal from reducing the voltage resistance and from having a bad influence to electrical field in the vicinity of the insulating tube 9. Therefore, electrons can efficiently be detected.

The manganese bead 17 and antimony bead 19 are surrounded by the tubular outer wall 74. Therefore, when the photocathode 11 is formed, the outer wall 74 can prevent the metal vapor from being adhered to portions other than the upper hemisphere 4*a* of the envelope 2 with a simple structure and minimal size. By limiting the photocathode 11 to a minimally required area (upper hemisphere 4*a*), the electrons are not emitted from the portions other than the effective area of the envelope 2, reducing contribution of a dark current to the signal.

The APD 15 is surrounded by the cover 71 and tubular inner wall 72. Since the inner wall 72 prevents the metal vapor of manganese or antimony from being adhered to the APD 15, the characteristics of the APD 15 is prevented from degrading with a simple structure and minimal size. Further, limitation on the incident direction of the photoelectrons further increases detection sensitivity.

The manganese bead 17 and antimony bead 19 are disposed in the vicinity outside the APD 15, so that the metal vapor of manganese or antimony diffuses all over the upper hemisphere 4*a*. Therefore, the photocathode 11 can widely be formed on the entire upper hemisphere 4*a*.

When the signal from APD 15 is detected, the capacitors C1 and C2 in the insulating tube 9 which are located near the APD 15 remove direct current components, so that response is not affected. Further, the electrical circuit 90 is encapsulated inside the insulating tube 9 with the filling material 94, so that humidity resistance is increased and thereby the electron tube 1 can easily be used in water. This prevents respective components of the electrical circuit 90 except for the terminals N1 to N4 from directly being touched by hands, increasing safety.

<First Modification>

Figure 13:
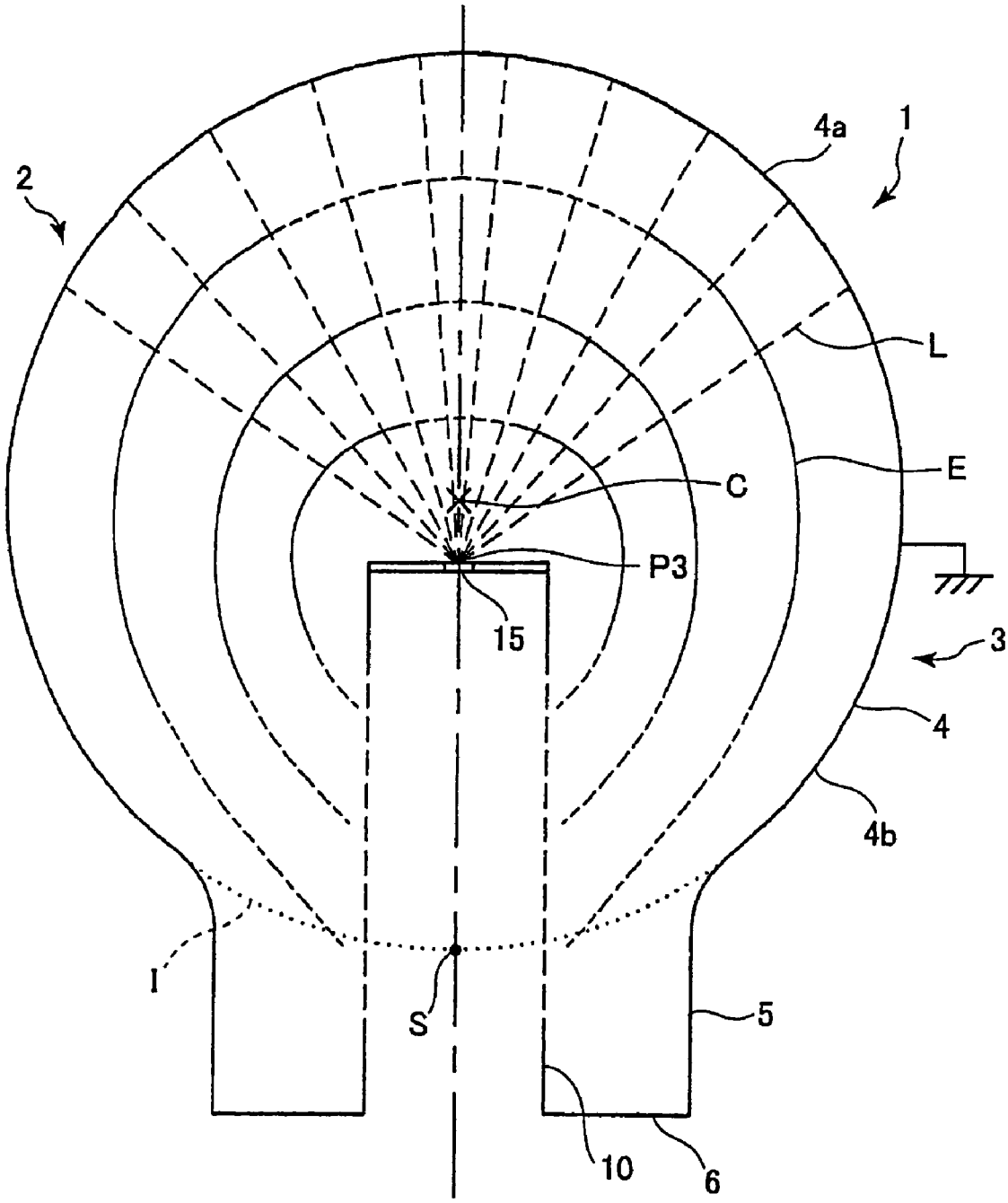
FIG. 13 is a vertical cross-sectional view schematically showing equipotential surfaces E and electron trajectories L in the case where the vertical cross-section of a glass bulb body is formed into a circular shape.

As shown in FIG. 13, the vertical cross-section of the glass bulb body 4 including the axis Z may be substantially a circular shape. In this case, the diameter of the glass bulb body 4 perpendicular to the axis Z is substantially equal to the diameter thereof parallel to the axis Z.

Also in this case, the APD 15 may be disposed on the glass bulb body 4 side (upper side in FIG. 13) relative to the reference point S at which the imaginary extended curved surface I of the lower hemisphere 4*b* of the glass bulb body 4 crosses the axis Z in the glass bulb base 5. The point c denotes the center of the glass bulb body 4.

Equipotential surfaces E are generated by a potential difference between the envelope 2 and the APD 15 and, accordingly, the electrons from the photocathode 11 fly along the trajectories L. Therefore, the electrons are converged on a point P3 in the vicinity of the upper surface of the APD 15, which is located slightly below the point C.

By disposing the APD 15 on the glass bulb body 4 side relative to the reference point S as described above, the electrons emitted from the photocathode 11 can efficiently enter the APD 15, thereby increasing detection efficiency.

Figure 14:
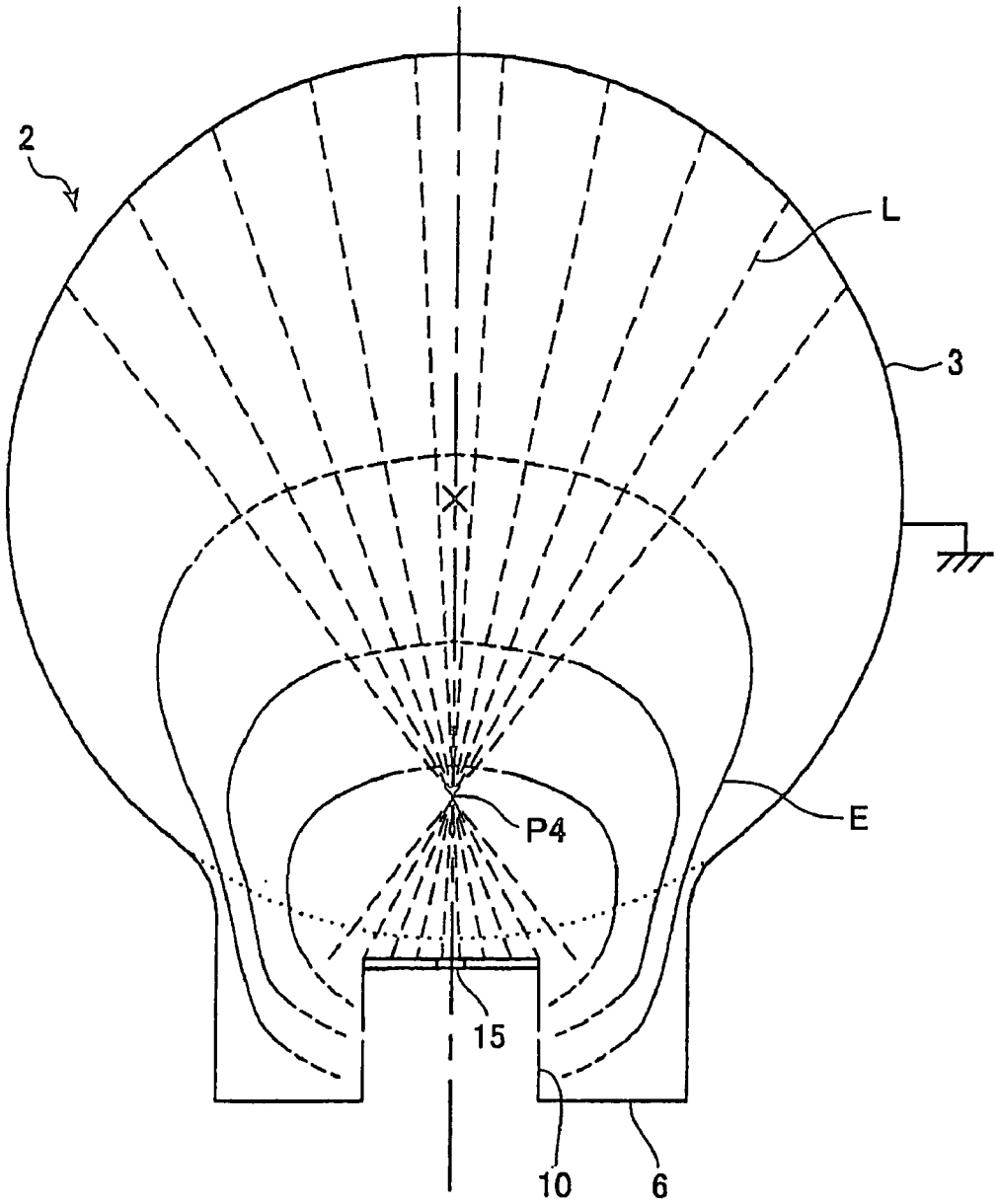
FIG. 14 is a vertical cross-sectional view schematically showing equipotential surfaces E and electron trajectories L in a comparative example.

As a comparison example, a case where the APD 15 is disposed on the lower side relative to the reference point S is shown in FIG. 14. In this case, the equipotential surfaces E are generated as shown in FIG. 14 by a potential difference between the envelope 2 and the APD 15. Accordingly, electrons are emitted from the photocathode 11 along trajectories L of FIG. 14. As a result, electrons from the photocathode 11 are converged on a point P4. The electrons diffuse at the position of the APD 15, as shown in FIG. 14. Therefore, the electrons emitted from the photocathode 11 may not enter the APD 15 efficiently.

<Second Modification>

Figure 15:
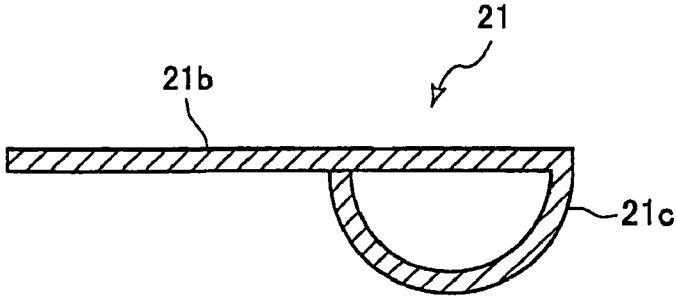
FIG. 15 is a vertical cross-sectional view showing the outer periphery of the conductive flange according to a modification.

In the above embodiment, the leading end 21*c* of the conductive flange 21 has a rounded shape having a greater thickness than that of the flange body 21*b*. Alternatively, however, the configuration of the leading end 21*c* of the conductive flange 21 may be obtained by rolling up the outer periphery of the flange body 21*b*, as shown in FIG. 15.

Similarly, the configuration of the leading end 23*d* of the conductive flange 23 may be obtained by rolling up the outer periphery 23*d* of the rising portion 23*c*.

<Third Modification>

Figure 16:
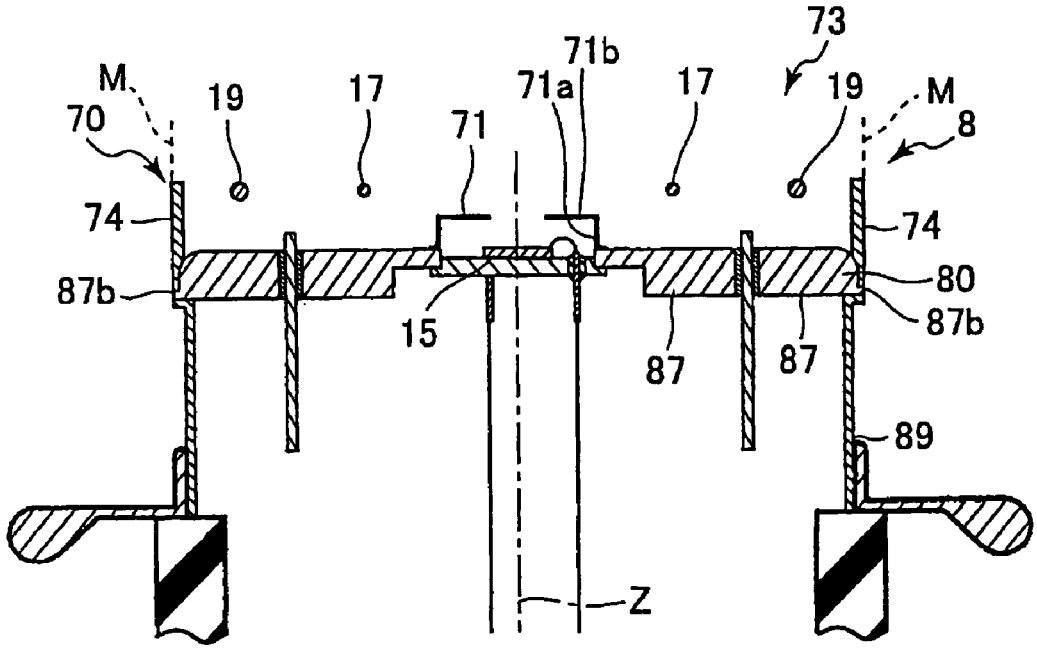
FIG. 16 is a vertical cross-sectional view showing the configuration of a shield portion according to another modification.

As described with reference to FIG. 3, in the above embodiment, the cap 73 of the shield portion 70 has the inner wall 72, ceiling 76, and outer wall 74. Alternatively, however, the inner wall 72 and ceiling 76 may be removed from the cap 73, as shown in FIG. 16. In this case, the cap 73 is constituted by only the outer wall 74.

Also in this case, the manganese beads 17 and antimony beads 19 are disposed at the portions on the upper side (i.e., the upper hemisphere 4*a* side) relative to the base 87 and between outer wall 71*a* of the cover 71 and imaginary extended curved surface M of the outer periphery 87*b* of the base 87, as in the above embodiment which has been described with reference to FIG. 1. Therefore, the base 87 and outer wall 74 prevents the manganese vapor or antimony vapor from being adhered to the internal surface of the glass bulb base 5, the outer stem 6, or lower hemisphere 4*b*. Further, the cover 71 prevents the manganese vapor or antimony vapor from being adhered to the APD 15.

Figure 17:
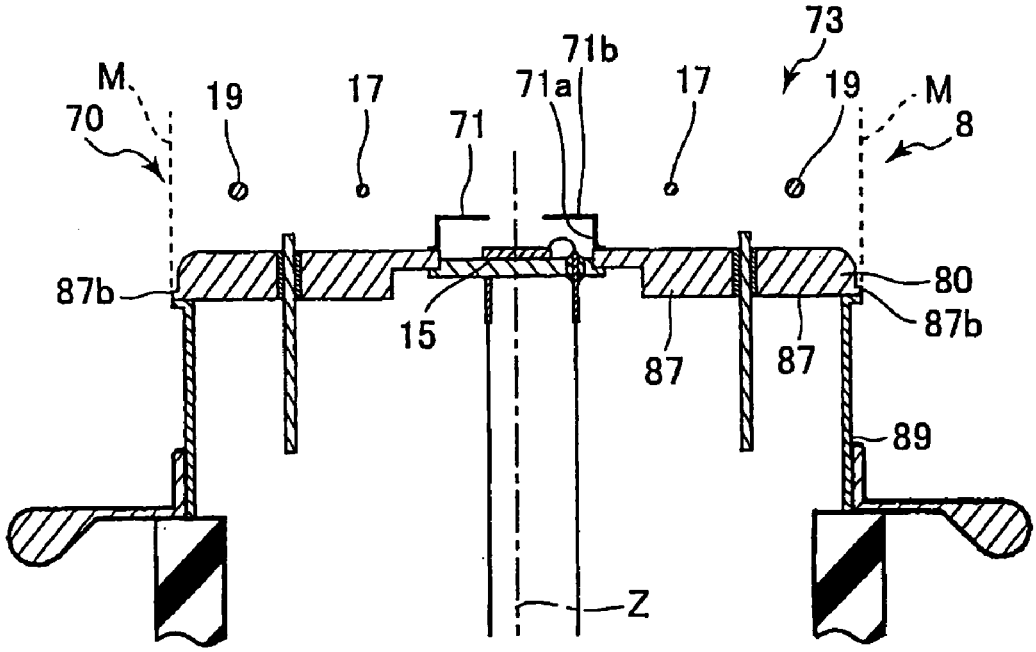
FIG. 17 is a vertical cross-sectional view showing the configuration of the shield portion according to still another modification.

Further, as shown in FIG. 17, the entire cap 73 may be removed from the shield portion 70. In this case, the shield portion 70 is constituted by only the cover 71. Also in this case, the manganese beads 17 and antimony beads 19 are disposed at the portions on the upper side (i.e., the upper hemisphere 4*a* side) relative to the base 87 and between outer wall 71*a* of the cover 71 and imaginary extended curved surface M of the outer periphery 87*b* of the base 87, as in the above embodiment which has been described with reference to FIG. 1. Therefore, the base 87 prevents the manganese vapor or antimony vapor from being adhered to the internal surface of the outer stem 6, or glass bulb base 5. Further, the cover 71 prevents the manganese vapor or antimony vapor from being adhered to the APD 15.

Although not shown, the cap 71 only needs to have the outer wall 71*a*. That is, the cap 71 need not always include the ceiling 71*b*. This is because the outer wall 71*a* can prevent the manganese vapor and antimony vapor from being adhered to the APD 15.

<Fourth Modification>

Figure 18:
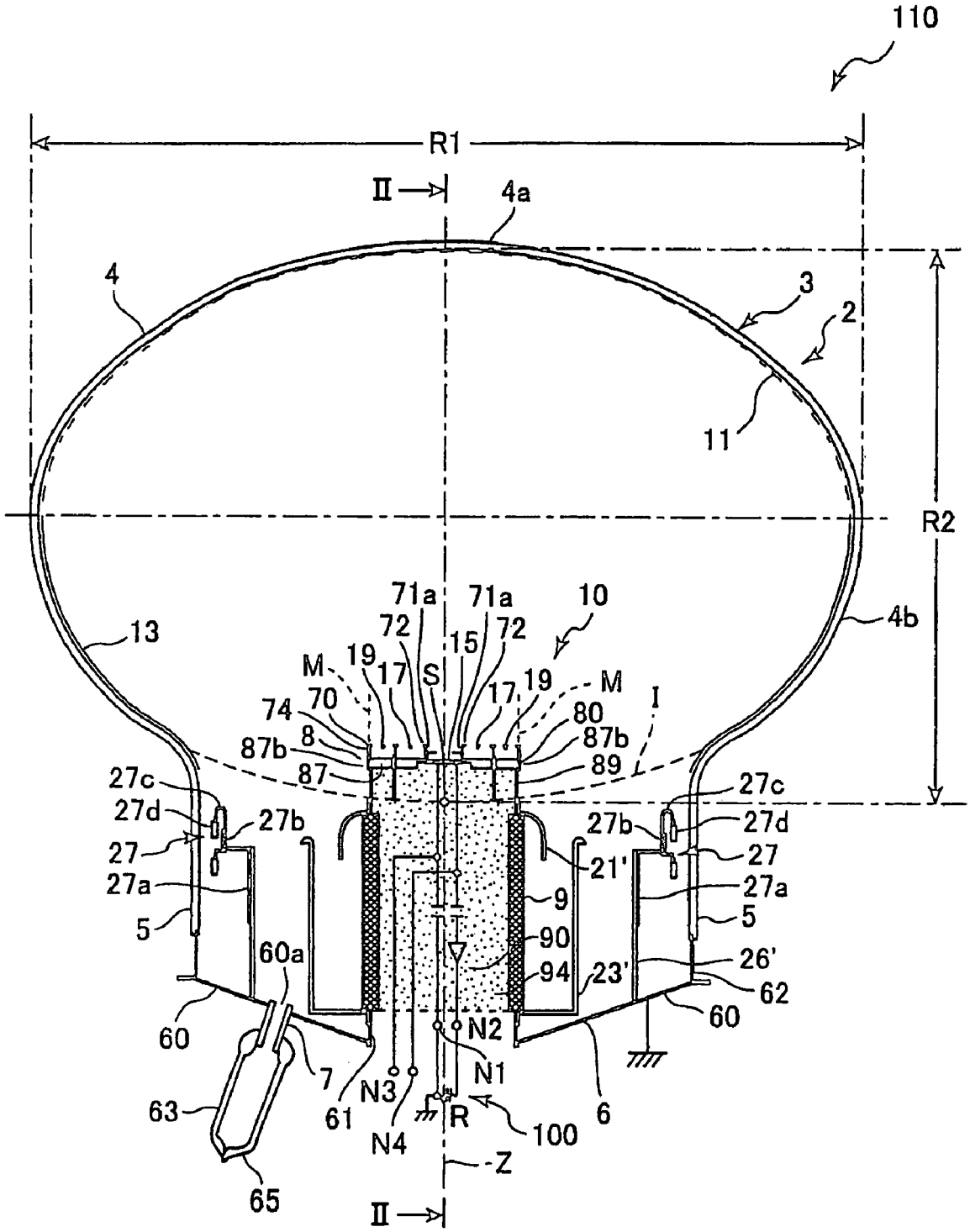
FIG. 18 is a cross-sectional view schematically showing an electrode tube according to another modification.

While the partition wall 26 has functions of shielding the tube 9 from the alkali metal vapor and supporting the alkali source 27 in the above embodiment, an electron tube 110 according to a fourth embodiment, as shown in FIG. 18, may include a support member 26' in place of the partition wall 26 of FIG. 1 and conductive flanges 21', 23' in place of the conductive flanges 21, 23 of FIG. 1. The support member 26, has only the support function. The conductive flanges 21', 23' have the field intensity reduction function of the conductive flanges 21, 23 and shield function of the partition wall 26.

Figure 19:
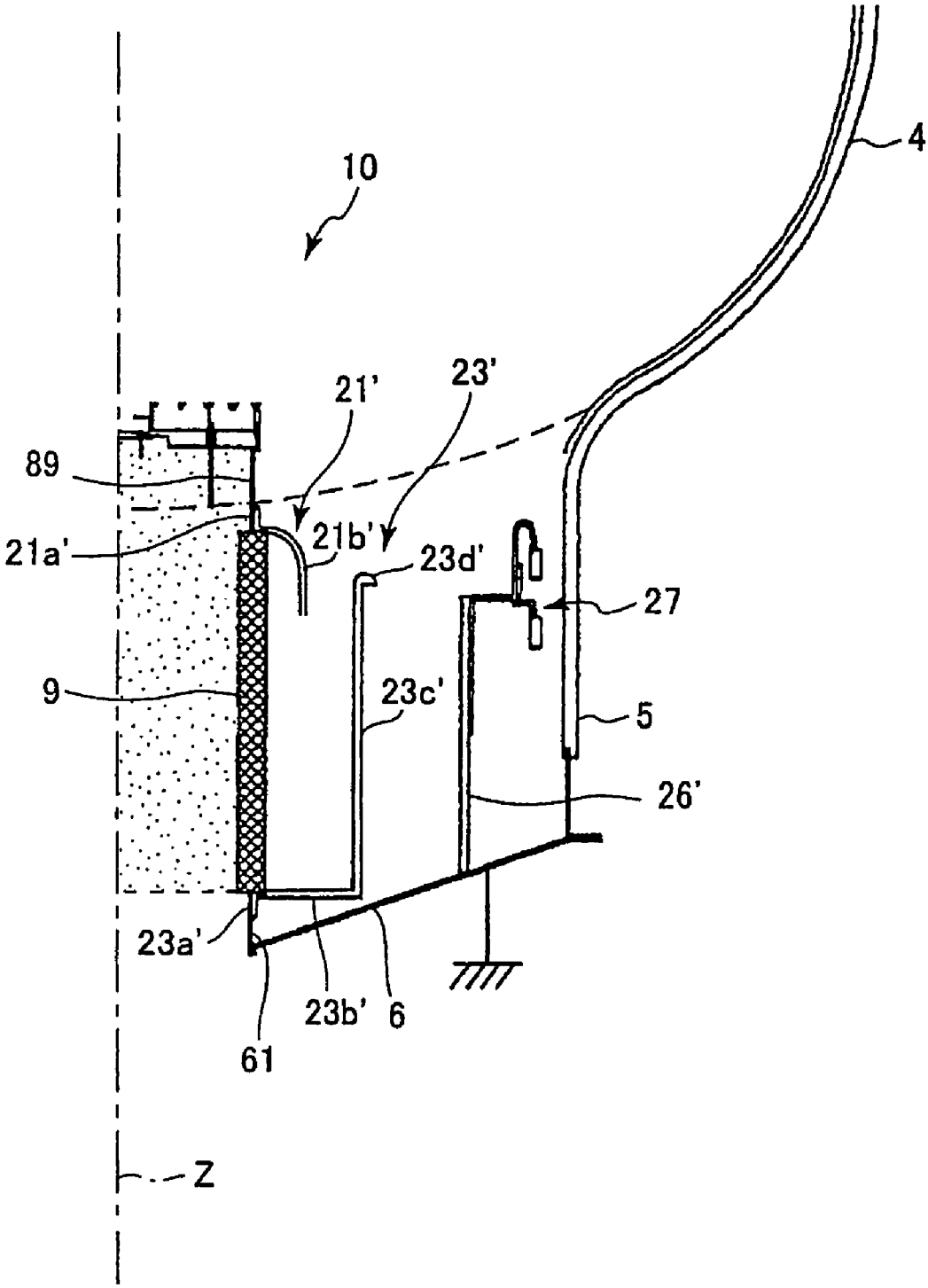
FIG. 19 is a detailed explanatory view showing conductive flanges 21', 23', and a support member 26'.

FIG. 19 is a detailed explanatory view showing the conductive flanges 21', 23', and support member 26'. In this modification, the support member 26' is provided in place of the partition wall 26. Like the partition wall 26, the support member 26' has a cylindrical shape and is provided so as to surround the tube 9. As in the case of the above embodiment, the alkali source 27 is fixedly attached to the support member 26' on the side thereof opposed to the glass bulb base 5. However, in the above embodiment, the partition wall 26 extends upward relative to the position to which the alkali source 27 is fixed and the upper end of the partition wall 26 is located on the upper side relative to the entire alkali source 27; whereas the upper end of the support member 26' in this modification is located on the lower side relative to the upper end of the partition wall 26 and at the same height as the uppermost portion of the support portion 27*a* of the alkali source 27.

The conductive flange 23' is provided at the lower end of the insulating tube 9 in place of the conductive flange 23 of FIG. 1. Like the conductive flange 23, the conductive flange 23, has a connection portion 23*a*', a flange body 23*b*', a rising portion 23*c*', and a rounded tip end 23*d*'. The connection portion 23*a*', which has a cylindrical shape, is fixed to the outer side surface of the cylindrical stem inner wall 61. The flange body 23*b*' has an annular plate-like shape extending in the direction away from the axis Z. The peripheral edge of the flange body 23*b*' is located on the outer side (on the side away from the axis Z with respect to the radial direction) relative to the peripheral edge of the flange body 23*b* (FIG. 3) of the conductive flange 23 with respect to the radial direction. The peripheral edge of the rising portion 23*c*' is located on the inner side (on the near side of axis Z with respect to the radial direction) relative to the support member 26'. The rising portion 23*c*' has a cylindrical shape rising from the peripheral edge of the flange body 23*b*' and extending upward in parallel to the axis Z and covers nearly the entire insulating tube 9. The rounded tip end 23*d*' extends from the upper end of the rising portion 23*c*' in a direction away from the axis Z. The rounded tip end 23*d*' has a greater thickness than those of the connection portion 23*a*', the flange body 23*b*', and the rising portion 23*c*', and has a thick rounded shape.

The conductive flange 21' is provided at the upper end of the insulating tube 9 in place of the conductive flange 21 of FIG. 1. The conductive flange 21' has a connection potion 21*a*' and a flange body 21*b*'. The connection portion 21*a*', which has a cylindrical shape, is fixed to the outer side surface of the cylindrical conductive support portion 89. The flange body 21*b*' has an annular plate-like shape hanging from the upper end of the insulating tube 9 to extend in the direction away from the axis Z. As viewed in the vertical cross section, the flange body 21' has a parabolic curved shape. The upper end of the conductive flange 23' is located on the upper side in the direction parallel to the axis Z and located on the side away from the axis Z in the radial direction, relative to the lower end of the conductive flange 21'. In other words, the flange body 21*b*' of the conductive flange 21' and rising portion 23*c*' of the conductive flange 23' are partially overlapped with each other in the direction parallel to the axis Z.

In the electron tube 110 having the above configuration, the conductive flange 21' and conductive flange 23' shield the insulating tube 9 while being overlapped with each other. This can prevent the alkali metal vapor which is generated from the alkali source 27 for forming the photoelectrical surface 11 from being deposited onto the insulating tube 9. Further, since the conductive flanges 21' and 23' are located nearer to the insulating tube 9 than the partition wall 26 of the above embodiment, the alkali metal vapor shielding effect can be increased more than in the case of the above embodiment where the shielding is made by the partition wall 26. Further, since the upper end of the support member 26' is lower than the upper end of the partition wall 26, the size of the support member 26' can be reduced relative to that of the partition wall 26.

In order to shield the tube 9 from the alkali metal vapor, the alkali source 27 needs to be provided outside the partition wall 26 in the above embodiment. In this modification, on the other hand, the alkali source 27 may be provided outside the conductive flanges 21' and 23'. For example, the alkali source 27 may be provided on one side of the support member 26' that faces the conductive flange 23'. In this case, the alkali source 27 may be disposed between the conductive flange 23' and support member 26'. Further, the alkali source 27 may be held by the conductive flange 23, as far as the alkali source 27 is located further away from the axis Z than the rising portion 23*c*' of the conductive flange 23'. In this case, the support member 26' need not be provided. Since the alkali source 27 can be located near the insulating tube 9 as described above, the radius of the glass bulb base 5 and the area of the stem 6 can be reduced, contributing to cost reduction. The conductive flanges 21' and 23' also have a function of reducing the field intensity in the peripheral portion of the insulating tube 9, thereby preventing occurrence of discharge at the upper and lower ends of the insulating tube 9.

The flange body 21*b*' may be disposed further away from the axis Z than the rising portion 23*c*' of the conductive flange 231. The flange body 21*b*' may extend downward in parallel to the axis Z so as to cover nearly the entire insulating tube 9. The tube 9 may be shielded from the alkali metal vapor only by the conductive flange 21' or only by the conductive flange 23'. The conductive flange 21' may have a cylindrical shape like the conductive flange 23'. The conductive flange 23' may have a parabolic cross-section like the conductive flange 21'. The conductive flange 21' may have a rounded tip end. Although the support member 26' is formed into a cylindrical shape that surrounds the tube 9 in a continuous 360-degree arc in the above embodiment, the support member 26' may be provided only at the portion needed for supporting the alkali source 27.

<Other Modifications>

In the above embodiment, the stem bottom 60, stem outer wall 62, and stem inner wall 61 that constitute the outer stem 6 are formed from Kovar metal. Alternatively, however, the stem bottom 60, stem outer wall 62, and stem inner wall 61 may be formed from conductive material other than the Kovar metal.

Further, only the stem inner wall 61 to be connected to the insulating tube 9 needs to be formed from a conductive material. The stem bottom 60 and stem outer wall 62 may be formed from an insulating material. Further, only a part of the stem inner wall 61 that is connected to the insulating tube 9 may be formed from a conductive material.

In the above embodiment, the base 87 and APD stem 16 that constitute the inner stem 80 are formed from a conductive material. Alternatively, however, the base 87 and APD stem 16 may be formed from an insulating material. At least the connection portion with the pin 30 in the APD stem 16 needs to be formed from a conductive material.

The photocathode 11 may be formed not on the entire surface of the upper hemisphere 4*a*, but on a part (for example, an area around the axis Z) of the surface of the upper hemisphere 4*a*. In this case, the conductive thin film 13 is formed on a part of the glass bulb body 4 at which the photocathode 11 has not been formed, and electrical continuity is established between the photoelectrical surface 11 and conductive thin film 13.

The partition wall 26 need not always be formed from a conductive material. Any material can be used to form the partition wall 26 as long as the material can prevent the vapor from the alkali sources 27 and 27 from being deposited onto the electron detection section 10 and does not disturb the electrical field in the electron tube 1.

The numbers and positions of manganese beads 17 and antimony beads 19 are not limited to those described above. Different numbers of manganese beads 17 and antimony beads 19 may be provided at different positions on the base 87.

In the above embodiment, the inner stem 80 includes the APD stem 16 and the base 87 and the APD stem 16 is fixed to the base 87 so as to cover the through-hole 87*a* formed in the base 87. Alternatively, however, the base 87 may be formed into substantially a circular shape and the inner stem 80 may be constituted by only the circular-shaped base 87. In this case, the APD 15 is disposed at substantially the center of the base 87.

Each of the conductive flanges 21 and 23 has a plate-like shape that circumferentially extends from the axis Z of the cylindrical electron detection section 10 to the cylindrical glass bulb base 5 on the plane perpendicular to the axis Z. However, the configuration of the conductive flanges 21 and 23 is not limited to this. The conductive flanges 21 and 23 only need to protrude from the upper and lower end portions of the insulating tube 9 in the direction away from the axis Z to thereby reduce concentration of the equipotential surfaces in the vicinity of the upper and lower end portions of the insulating tube 9. Further, the outer peripheries of the conductive flanges 21 and 23 need not always be rounded.

When there is no possibility that the equipotential surfaces concentrate on the upper end portion of the insulating tube 9, the conductive flange 21 need not be provided. Similarly, when there is no possibility that the equipotential surfaces concentrate on the lower end portion of the insulating tube 9, the conductive flange 23 need not be provided.

If no disadvantage is found, a negative voltage may be applied to the envelope 2 and a ground voltage may be applied to the APD 15.

The exhaust pipe 7 may be provided not at a portion between the insulating tube 9 and partition wall 26 but at other portions such as a portion between the partition wall 26 and glass bulb base 5.

The insulating tube 9 may be formed not into a cylindrical shape but into a square tubular shape.

Any type of an electron-bombarded semiconductor device may be adopted in place of the APD 15.

The APD 15 may be provided on the lower side relative to the reference point S as far as detection of the electron can satisfactorily be performed.

The alkali sources 27 and 27 are disposed facing each other with respect to the insulating tube 9. Alternatively, however, the alkali sources 27 and 27 may adjacently be disposed. By adjacently disposing the alkali sources 27 and 27, work simplification can be achieved. For example, the alkali sources 27 and 27 can be heated by only one electromagnet.

Although the amplifier A1 is provided within the insulating tube 9 in order to detect signals more clearly in the above embodiment, the amplifier A1 need not always be provided. In this case, the capacitor C1 is directly connected to the output terminal N2.

While the preferred embodiment of the electron tube according to the present invention has been described with reference to the drawings, the present invention is not limited to the above embodiment. It will be apparent to those skilled in the art that various changes and modifications are possible without deviating from the broad principles and spirit of the present invention which shall be limited solely by the scope of the claims appended hereto.

The manganese beads 17 and antimony beads 19 need not always be provided. Alternatively, inlets of the manganese vapor and antimony vapor are formed in the envelope 2 and manganese vapor and antimony vapor are introduced from the outside through the inlets to thereby form the photocathode. In this case, the cap 73 need not be provided.

The capacitors C1, C2, and amplifier A1 of the electrical circuit 90 may be provided not inside the insulating tube 9 but outside the electron tube 1.

INDUSTRIAL APPLICABILITY

The electron tube according to the present invention, which can be used in various photodetection techniques, is in particular effective in single photon detection in water, such as the water Cerenkov experiment.

The invention claimed is:

1. An electron tube comprising:

an envelope formed with a photocathode at a predetermined part of an internal surface thereof;

an insulating tube having one end and another end, the another end being connected to the envelope and the one end protruding inside the envelope;

an electron-bombarded semiconductor device provided on the one end of the tube;

an alkali source provided inside the envelope to generate alkali metal vapor; and a separating member disposed between the alkali source and the tube, wherein the semiconductor device detects photoelectrons emitted from the photocathode in response to an incident light thereon.

2. The electron tube as claimed in claim 1, further comprising:

an inner stem connected to the one end of the tube via a conductive member; and a conductive member provided on the one end of the tube and protruding outside the tube to reduce the field intensity in the vicinity of the one end of the tube, wherein the semiconductor device is disposed on the inner stem.

3. The electron tube as claimed in claim 1, further comprising a conductive member provided on the another end of the tube and protruding outside the tube to reduce the field intensity in the vicinity of the another end of the tube, wherein the envelope further comprises an outer stem connected to the another end of the tube, at least a part of the outer stem that is connected to the another end of the tube being conductive.

4. The electron tube as claimed in claim 1, wherein the envelope is applied with a ground potential, and wherein the semiconductor device is applied with a positive potential.

5. The electron tube according to claim 1, wherein the separating member is either a conductive member provided on the one end of the tube and protruding outside the tube to reduce the field intensity in the vicinity of the one end of the tube or a conductive member provided on the another end of the tube and protruding outside the tube to reduce the field intensity in the vicinity of the another end of the tube.

6. The electron tube as claimed in claim 1, wherein the separating member includes a conductive member provided on the one end of the tube and protruding outside the tube to reduce the field intensity in the vicinity of the one end of the tube and a conductive member provided on the another end of the tube and protruding outside the tube to reduce the field intensity in the vicinity of the another end of the tube.

7. The electron tube as claimed in claim 6, wherein the conductive member and conductive member are partially overlapped with each other in the axial direction of the tube.

8. The electron tube as claimed in claim 2, wherein the envelope is applied with a ground potential, and wherein the semiconductor device is applied with a positive potential.

9. The electron tube as claimed in claim 3, wherein the envelope is applied with a ground potential, and wherein the semiconductor device is applied with a positive potential.

* * * * *